United States Patent [19]

Durant et al.

[11] 4,359,958

[45] Nov. 23, 1982

[54] CARGO TRANSPORT SYSTEM

[76] Inventors: Peter D. Durant, 17 Englewood Pkwy., Metairie, La. 70005; Paul A. Wolff, 2613 Dorchester Dr., Oklahoma City, Okla. 73120

[21] Appl. No.: 919,955

[22] Filed: Jun. 28, 1978

[51] Int. Cl.[3] ..... B63B 25/08

[52] U.S. Cl. ..... 114/74 A

[58] Field of Search ..... 114/72, 73, 74 R, 74 A, 114/74 T, 259, 260, 75; 220/1.5; 414/136, 137, 138, 139

[56] References Cited

U.S. PATENT DOCUMENTS

| | | | |
|---|---|---|---|
| 2,513,004 | 6/1950 | Cooley | 114/72 |
| 2,738,749 | 3/1956 | Macy et al. | 114/73 |
| 3,390,657 | 7/1968 | Schneider | 114/260 |
| 3,722,449 | 3/1973 | Goldman | 114/75 |
| 3,830,177 | 8/1974 | Nemec et al. | 114/73 |
| 3,861,341 | 1/1975 | Sorensen | 114/260 |

*Primary Examiner*—Trygve M. Blix

*Assistant Examiner*—Jesus D. Sotelo

*Attorney, Agent, or Firm*—Arnold, White & Durkee

[57] ABSTRACT

A cargo transport system is characterized by a container having a cargo carrying volume therein, the container being disposed within a receptacle. The container is movable with respect to the receptacle from a first, lowered, position to a second, elevated, position. In the second position, the exterior surface of the container and the receptacle cooperate to define a separate, commercially attractive cargo receiving volume adapted to receive therein a cargo different from the cargo disposable in the cargo carrying volume. The container may be lifted to and then locked into the elevated position. Cargo is introduced into the cargo receiving volume through a cargo access arrangement. The cargo transport system may be adapted for barge, rail, truck, or other transportation modes. Either the receptacle or the container, or both, may be insulated to facilitate carriage of an elevated temperature cargo within the container and/or the receptacle.

54 Claims, 33 Drawing Figures

12
14
24
104
88A
180
164A-1
10A
36A
20A
168
166
78
66A
19
5B
144A
92A
5A
4
106
48'
164A-2
164A-3
88B
10B
66B
36B
144B
92B
20B
18
16

24
26
22
14
12
10A
176
162
66A
38
50A
164A-1
20B
64A
88A
48'
19
92A
46
48
36A
10B
164A-2
50B
36B
66B
92B
88B

FIG. 4B
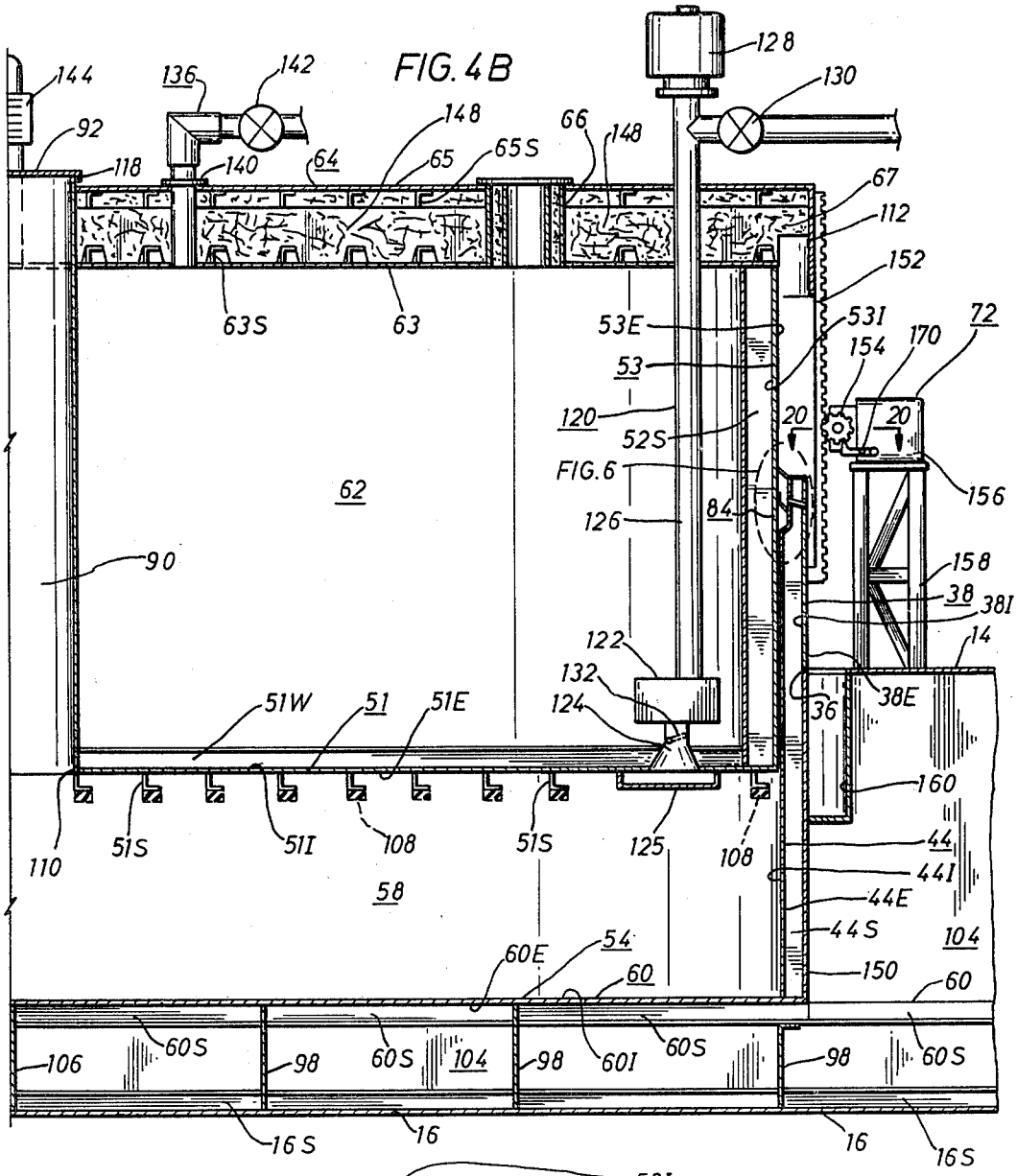
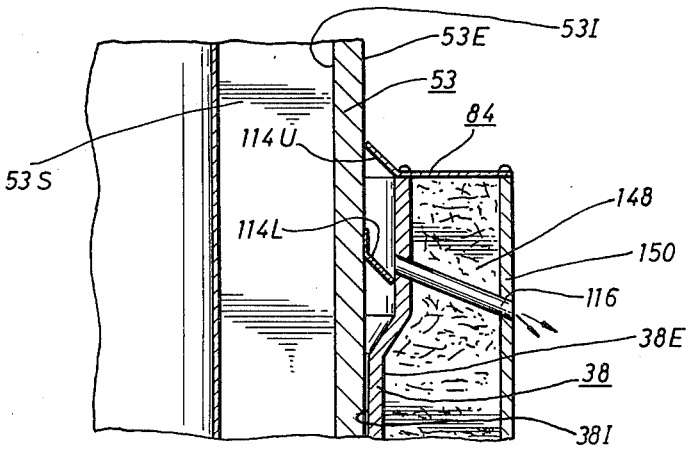
FIG.6

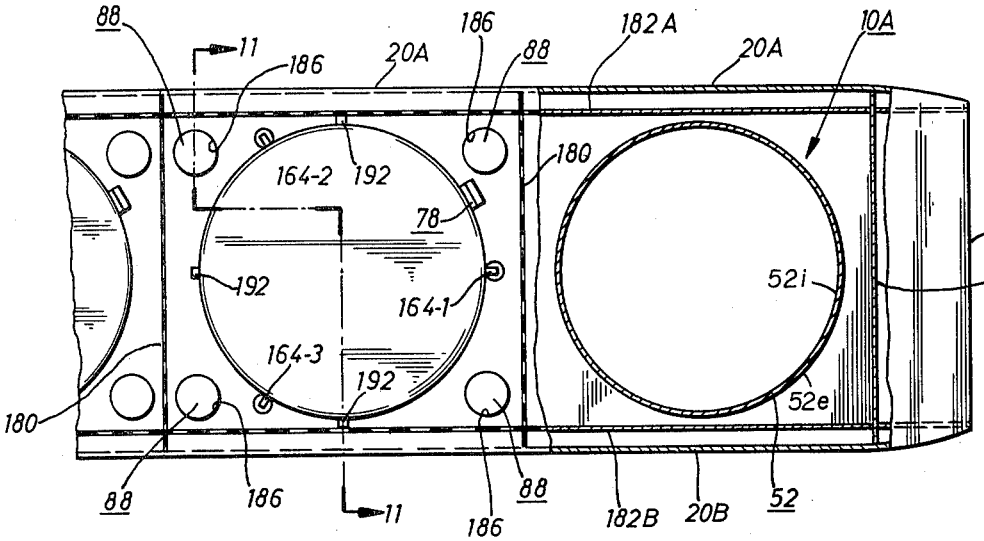
FIG.9
FIG. 10
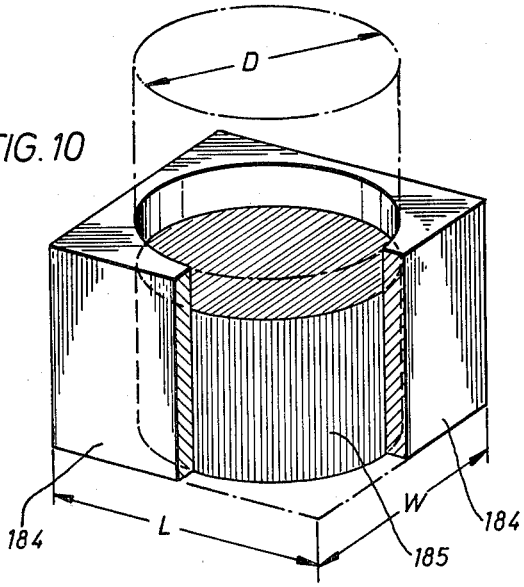
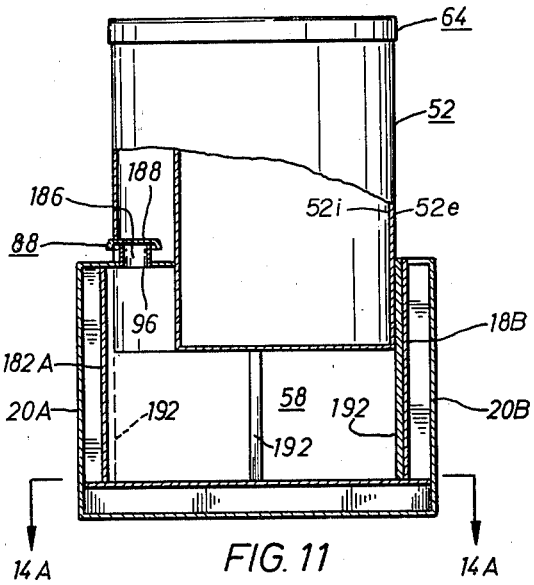
FIG. 11
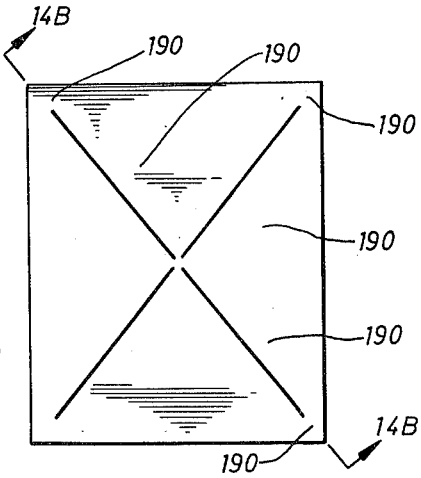
FIG.14 A
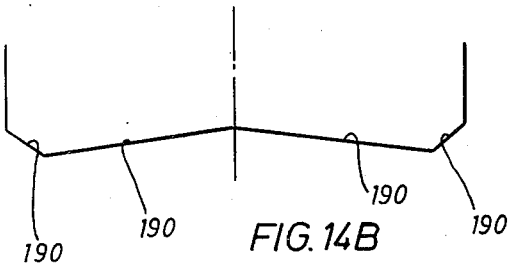
FIG. 14B FIG. 15B
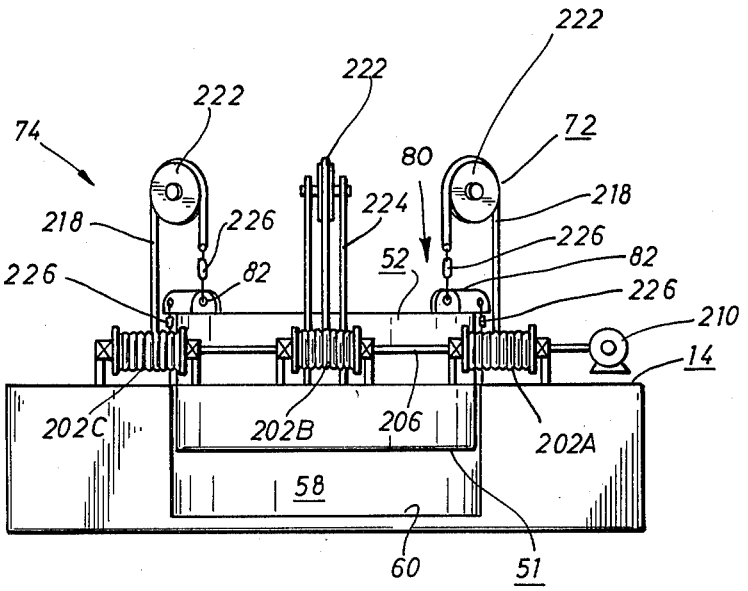
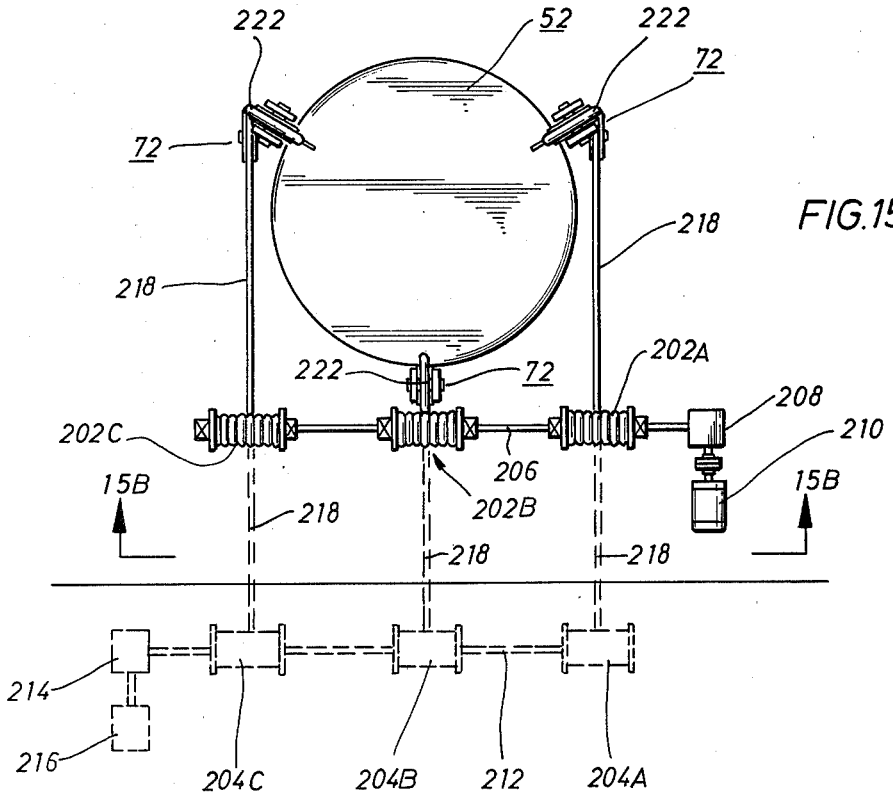
FIG. 15A

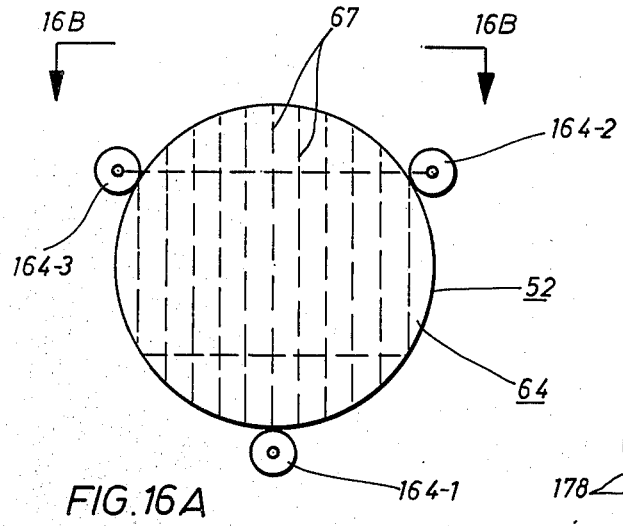
FIG. 16A
FIG. 16B
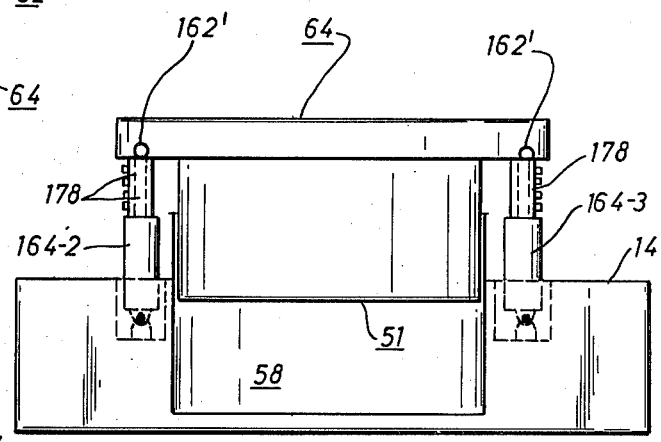
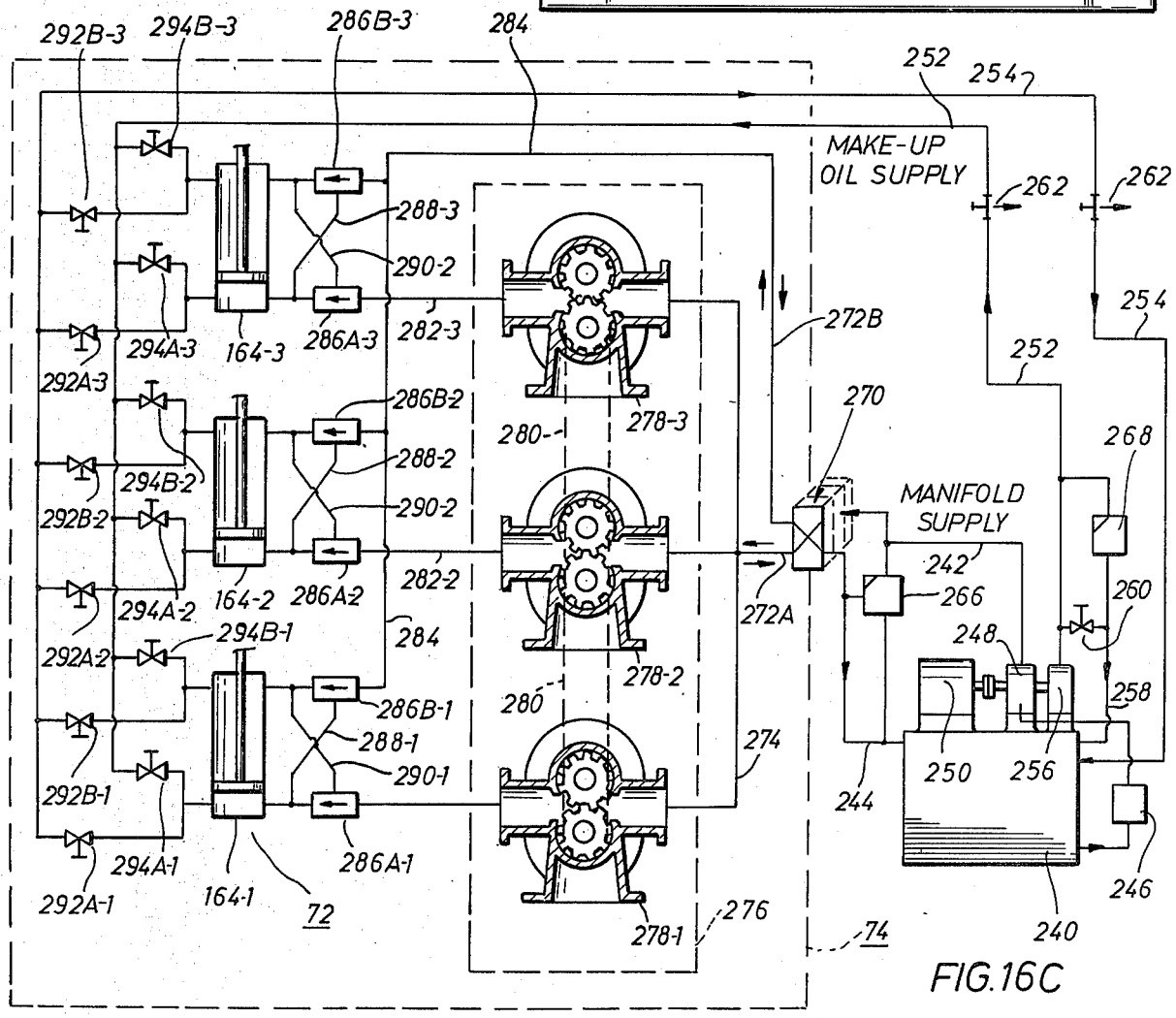
FIG. 16C

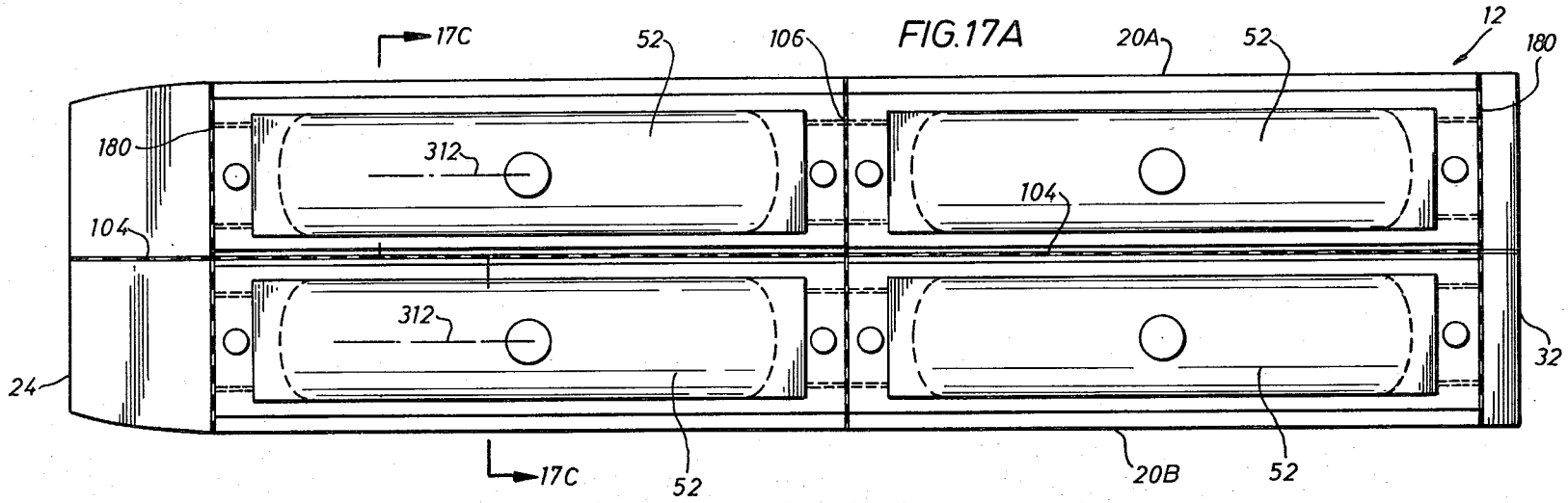
FIG.17A
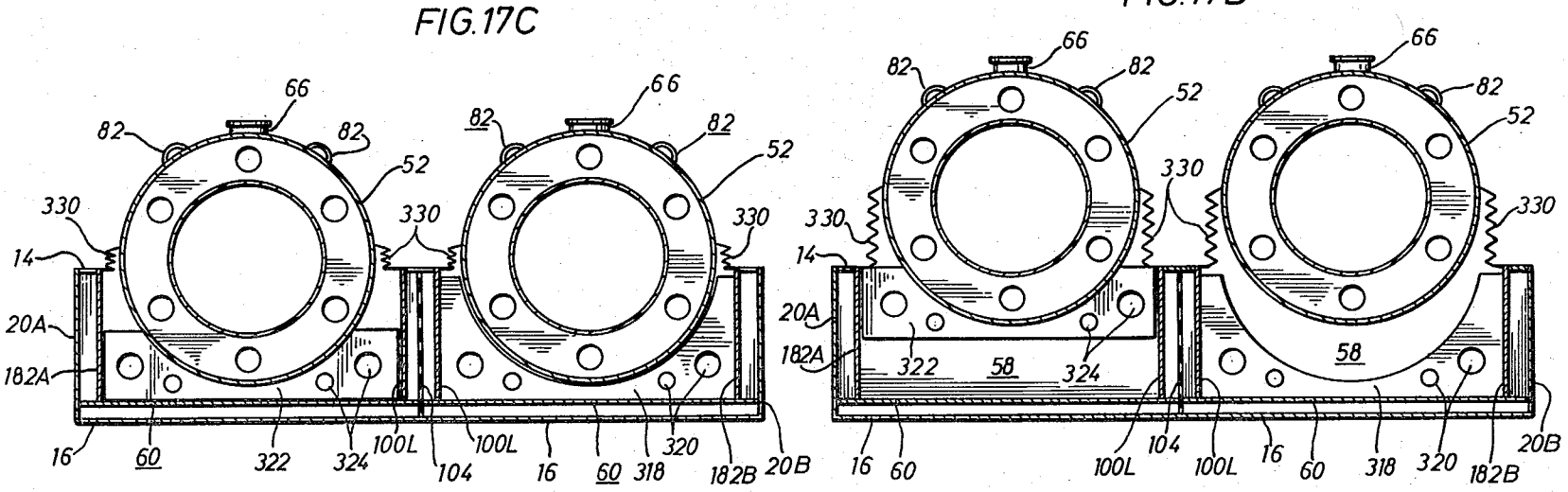
FIG.17D
FIG.17C

FIG. 21B
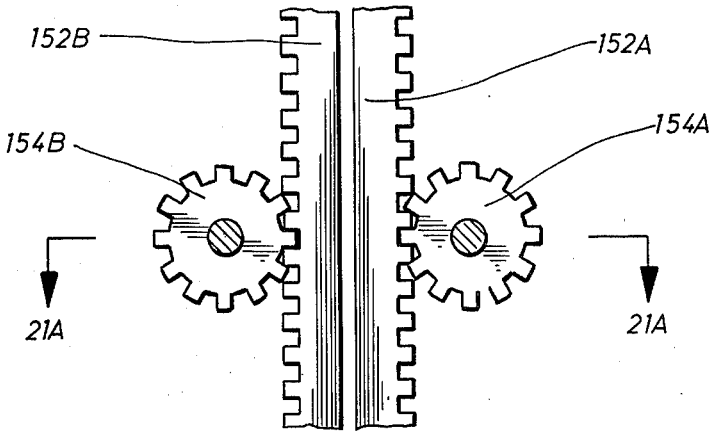
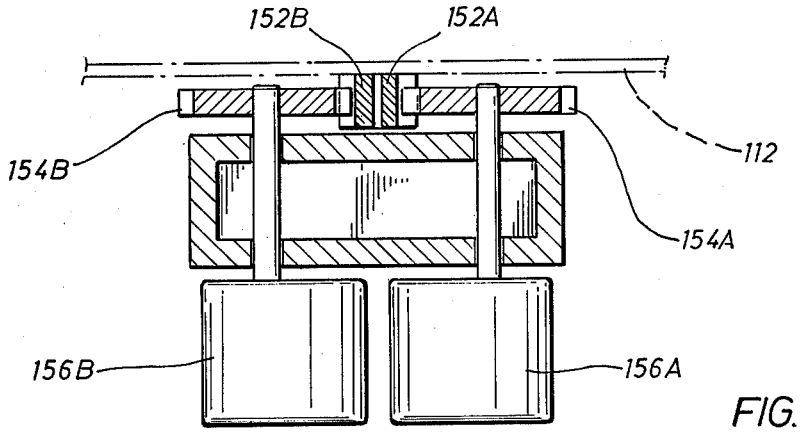
FIG. 21A
FIG. 20
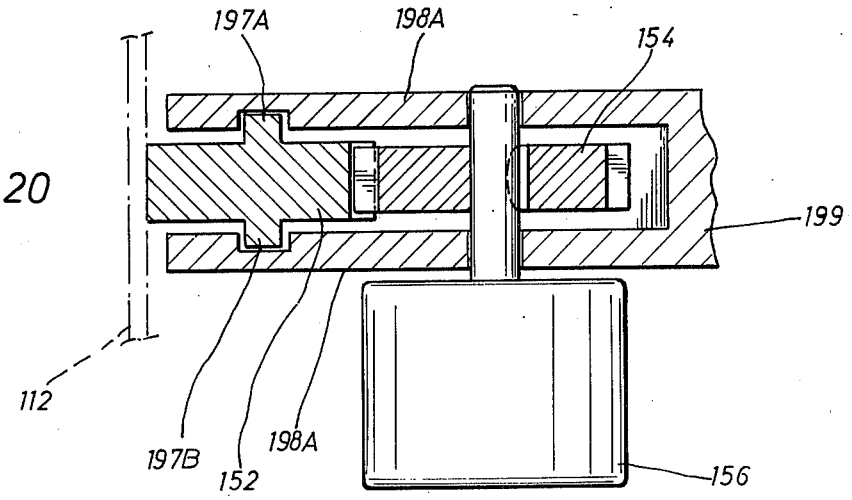

CARGO TRANSPORT SYSTEM

BACKGROUND OF THE INVENTION

1. Field of the Invention

This invention relates to a cargo transport system, and in particular, to a cargo transport system having a container movable within a receptacle such that elevation of the container defines a separate, cargo receiving volume of a commercially attractive capacity adaptable to receive a cargo distinct from the cargo carried by the container.

2. Description of the Prior Art

Waterborne transportation vessels, such as barges, are basically floating box beams having substantially horizontal upper and lower flanges connected by two or more substantially vertical webs. The upper and lower flanges are respectively defined by the barge deck and barge bottom while the webs are defined by the barge side shells. It is common practice in the art to dispose interior members known as the inner bottom and inner longitudinal bulkheads, respectively, in parallel structural relationship to the bottom and to the side shells of the barge. Suitable partitioning and/or load-carrying transverse bulkheads may be transversely disposed between the various longitudinal members. A minimum amount of partitioning is generally required both as a safety measure against sinking due to collision and as a safety measure against overturning due to loss of stability because of what is known in the art as "free surface effect" of liquids contained within the bounding surfaces of the vessel. The "free surface effect" accompanies the presence of any liquid that does not completely fill or "press up" its enclosing space whether it be liquid cargo, water ballast, or bilge water from leakage. An effect similar to that of liquid free surface may accompany cargos that are susceptible to shifting, such as grain.

The minimum number of complete watertight transverse interior bulkheads is usually taken as two, being those necessary as "collision bulkheads" to isolate the forwardmost and the aftmost rake tanks from the remainder of the vessel. The minimum number of longitudinal bulkheads is usually taken as one. Where there is only one longitudinal bulkhead it is almost invariably installed on the centerline of the vessel. In locations where a complete watertight bulkhead is not required, a "swash" bulkhead may be installed which is watertight only from its lower boundaries up to some predetermined height that is less than the full height of the compartment.

In some installations, an interior longitudinal bulkhead may be located in relatively close proximity to the side shell in which case the tank space created adjacent the side shell is known in the art as a "wing tank". The "wing tanks" are typically adapted to receive cargos such as molasses, lard oil, and petroleum products.

The spaces defined by the longitudinal bulkheads (or a longitudinal bulkhead and/or one sideshell and the other sideshell), transverse bulkheads and inner bottom (or bottom shell) may receive bulk cargo such as ores, concentrates, grains, and the like; in special cases the spaces may carry liquid cargo or liquid ballast.

One typical arrangement is known in the art as the OBO, signifying oil-bulk-ore cargo transport. The volume between the inner and outer bottoms may receive liquids such as clear liquid cargo, fuel, potable water, ballast water, or the like. Unloading apparatus, such as augers or conveyors, for transferring cargo from its area may be disposed within the space defined between the cargo and the uppermost bottom plate. If an inner bottom is provided, the unloading apparatus is usually disposed thereabove. If the barge has no inner bottom, the unloading apparatus is disposed above the lower bottom.

There are several disadvantages attendant with the standard vessel construction above-described. For example, cargo carried within the wing tanks or other tanks capable of holding cargo may be intimately intermingled with the intricate truss and support structures supporting the inner and outer plating of the vessel. This makes it difficult to carry other than a particular type of cargo within the wing tank volume. As stated, typically this cargo is molasses, lard oil, or petroleum. If, for any reason, the outer side shell or outer bottom loses its integrity, the cargo carried therewithin may escape with the consequential deleterious environmental aftermath associated with a spill. Further, loss of integrity of the kind discussed immediately above may expose the unloading apparatus to the external environment. The possibility then exists that water could enter the inner storage volumes through the unloading apparatus and thereby add appreciably to the weight of the vessel, possibly to the extent that the vessel may sink. Due to the interconnection of the cargo volumes through the unloading apparatus and the possibility of sinking if the integrity of the vessel is lost, prior art vessels require complex and expensive safety apparatus to guard against such occurrence.

Furthermore, it is difficult and expensive with vessels of the present construction to economically transport heated cargos such as hot asphalt and the like. Since such cargos must be heated in order to pump or otherwise remove them from the interior volumes of the vessel, it is necessary in the usual case to add heat to such cargo. This requirement further increases the expense of transport.

It is believed to be advantageous to provide a cargo transport system adaptable for barge, rail, truck, or other transportation modes wherein a container having a cargo carrying volume therein is movably disposed with respect to a receptacle such that a separate, commercially significant cargo receiving volume may be defined between the container and the receptacle when the container is in an elevated position. The cargo receiving volume may advantageously be utilized to transport a cargo dissimilar to the cargo carried within the container without risk of contamination thereby. It is also of advantage to provide an arrangement whereby the container may be lifted to an elevation to define a cargo receiving volume such that, when a cargo is disposed therein, the lower surface of the container operates to minimize free surface effects of the cargo. The lifting arrangement may be disposed on the carrier itself or the container may be provided with a connection arrangement to connect the container with a lifting arrangement disposed elsewhere. It would be of further advantage to utilize guide members adaptable to guide the movement of the container and, in connection with several arrangements of the guide member, serve to limit the shifting of a cargo within the cargo receiving volume.

The receptacle may be sized to receive the container such that a residual volume is defined between the container and the receptacle when the container is in a lowered position. The residual volume is combinable with the enlargement volume generated when the container is elevated to define the cargo receiving volume.

In view of the foregoing, it would also be advantageous to provide a cargo transport system having the container closely fitted within a receptacle formed by a continuous sleeve and bottom closure. Either the container or the receptacle or both may be insulated to carry hot cargos with a minimum of heat loss. Through the provision of an independent movable container, insulation of an entire bounding surface is expeditiously permitted to thereby facilitate carriage of a heated cargo. As a result, it is believed possible to avoid the heat loss from the material being transported in a manner more efficient than that known to the prior art. Furthermore, relatively little, if any, additional heat need be added to pump or otherwise remove certain cargo, such as asphalt, from the vessel.

The provision of the relatively movable container supported within the carrier itself permits the cargo carrying volume and the cargo receiving volume (defined respectively on the interior of the container and between the exterior of the container and the receptacle) to exhibit relatively smooth surface areas. The intermingling of cargo with the support structure of the vessel itself is thus avoided.

By the provision of the container/receptacle arrangement, the risk of spills is minimized. For example, in the event of a rupture or leak of the container, cargo carried therewithin is confined within the receptacle. Further, if the receptacle is disposed within plating other than side and bottom shell plating and if the receptacle leaks, the cargo contained therewithin still is confined to the interior of the barge shell.

Further advantage would be gained by the provision of containers of substantially standard size so that manufacture of the containers is expedited. Standardization enhances the transferability of cargos from, for example, a waterborne barge to an onshore rail transport, with a minimum of cost. Furthermore, standardization facilitates removal and repair of a faulty container yet permits a substitute therefor to be readily provided into the cargo transport vessel. Standardization also permits the carriage of different types of cargos by replacement of containers; for instance, the conversion of the barge from asphalt service to vegetable oil service could be achieved by removing the insulated asphalt container and installing a different container for vegetable oil with a suitable coating on the inside.

It would be of further advantage to provide the container and/or the receptacle with a geometry such as right-circular cylinders, right-elliptical cylinders, spheres and hemispheres, or ellipsoid and hemiellipsoids such that stress concentration factors attendant with geometries used by carriers (generally rectangular in configuration) are substantially reduced. Therefore, concern for expansion and contraction caused by thermal changes and transit conditions (such as waves or rail discontinuities) are believed to be effectively eliminated with the cargo transport system embodying the teachings of this invention.

SUMMARY OF THE INVENTION

This invention relates to a cargo transport system adapted for waterborne (either self-propelled or non-self-propelled) or onshore (truck or rail) environments. The system provides a container having a cargo carrying volume therein, the container being movably disposed within a receptacle. A lifting arrangement is provided to move the container from a first, lowered, position to a second, elevated, position. In the elevated position, the exterior of the container and the interior of the receptacle cooperate to define a separate cargo receiving volume of a commercially significant size wherein a second cargo (dissimilar, if desired, from the cargo in the container) may be transported without risk of intermingling or contamination. The container is secured in the elevated position by a locking arrangement such that the lower surface of the container limits the free surface effects of the cargo transported within the cargo receiving volume. A suitable cargo access arrangement for introducing cargo into the cargo receiving volume is provided. A connection arrangement may be provided to connect the container to a lifting arrangement which may be disposed other than on the carrier. An arrangement to synchronize operation of the lifting arrangement to maintain the exterior of the container in a parallel relationship with a datum as the container is moved to the second position may also be provided.

The receptacle may, in one modification in accordance with the invention, be defined by the interior plating of the barge or transport vehicle with the smooth side of the plating (the side of the plating opposite to which the stiffeners or other structural members are attached) bounding the receptacle and arranged so that a residual volume is defined between the container and receptacle when the container is in the lowered position. In such a case, the cargo receiving volume is the combination of the residual volume and an enlargement volume generated as the container is lifted to the elevated position. Access to the cargo receiving volume may conveniently be afforded through an array of hatches. A guide arrangement, either in the form of an array of rails or a perforated sleeve, is useful to guide the movement of the container from the lowered to the elevated positions. With the latter guide arrangement, the sleeve may also act as a shifting board, to thereby limit movement of cargo disposed in the cargo receiving volume.

In a second modification, the receptacle may also be defined by a continuous sleeve having a bottom closure connected thereto. The container is received by this type of receptacle in a close fitting relationship. In connection with this modified arrangement, when the container is in the elevated position, the cargo receiving volume is defined by the exterior of the container and the interior of the sleeve and bottom closure. The cargo access arrangement in this case may be provided by an encased shaft extending through the cargo carrying volume of the container and communicating with the cargo receiving volume. Access to the cargo carrying volume on the inside of the container may be provided by suitable loading and unloading means such as pumps and conveyors or through tight cargo hatches. The access to the cargo carrying volume may be located at any convenient location on the container. Particularly where flowable material is being added and withdrawn, suitable vents may be required.

In accordance with the invention, the container and/or the receptacle may be provided with suitable insulation to maintain the temperature of a heated cargo at an elevated level during transit. The container and/or the receptacle may be provided with a heating arrangement, if desired.

When the encased shaft is utilized as the cargo access arrangement, if the container and the encased shaft both exhibit right-circular geometry, the volume occupied by the encased shaft is related to the total volume of the container by the number generated by the square of the ratio of the diameters of the shaft and the container. The differential in volume occupied by the encased shaft may be restored to the container by increasing the sidewall height of the container by a dimension equal to the number generated by the square of the ratio of the diameter of the shaft to the diameter of the container multiplied by the effective height of the container. The effective height of the container is defined as the weighted average height of the cargo carried in the cargo carrying volume in the interior of the container.

BRIEF DESCRIPTION OF THE DRAWINGS

The invention will be more fully understood from the following detailed description thereof, taken in connection with the accompanying drawings, which form a part of the specification, and in which:

FIGS. 4A and 4B are elevational views, entirely in longitudinal section, taken along section lines 4—4 of FIG. 2 illustrating a cargo transport system embodying the teachings of this invention with the container thereof respectively shown in the first, lowered, and second, elevated, positions;

FIGS. 5A and 5B are elevational views, in transverse section, taken along section lines 5A—5A and 5B—5B, respectively, of FIG. 2, illustrating a cargo transport system in accordance with the teachings of this invention;

FIG. 6 is an enlarged view of the circled portion of FIG. 4B illustrating in detail a possible seal arrangement disposed between the container and the receptacle therefor;

FIG. 9 is a plan view of a barge having a cargo transport system in accordance with a modification of the invention with a portion of the barge structure cut away for clarity of illustration;

FIG. 10 is a perspective view of the volumetric relationship defined by the cargo transport system in accordance with FIG. 9;

FIG. 11 is an elevational view, partially in section, illustrating the container of the cargo transport system of FIG. 9 in the elevated position;

FIGS. 14A and 14B are diagrammatic views of a portion of the lower boundary of the receptacle shown in FIGS. 9 and 11 further modified in accordance with the invention;

FIGS. 15A and 15B are, respectively, a plan view and a side elevational view of an arrangement for synchronously controlling both the lifting and the lowering of a container by a winch and wire line and turnbuckle arrangement;

FIGS. 16A and 16B are, respectively, a plan view and a side elevational view of an arrangement for synchronously controlling both the lifting and lowering of a container by a hydraulic ram array and FIG. 16C is a schematic diagram of a synchronizing arrangement useful in conjunction with the hydraulic ram array of FIGS. 16A and 16B;

FIG. 17A is a plan view of an alternate embodiment of a container usable in accordance with either modification of the invention;

FIG. 17C is a sectional view taken along section lines 17C—17C in FIG. 17A, with the containers in the lower position, while in FIG. 17D, the containers are shown in the elevated position;

FIGS. 18A and 18B are, respectively, plan and elevational views of an alternate embodiment of a container in accordance with this invention, while

FIG. 19 is a perspective view of an alternate embodiment of a container in accordance with the invention; and, FIG. 20 is a sectional view taken along section lines 20—20 in FIG. 4B of a force compensation arrangement while FIGS. 21A and 21B show an alternative force compensation arrangement using two racks disposed back-to-back.

DESCRIPTION OF THE PREFERRED EMBODIMENT

Figure 1:
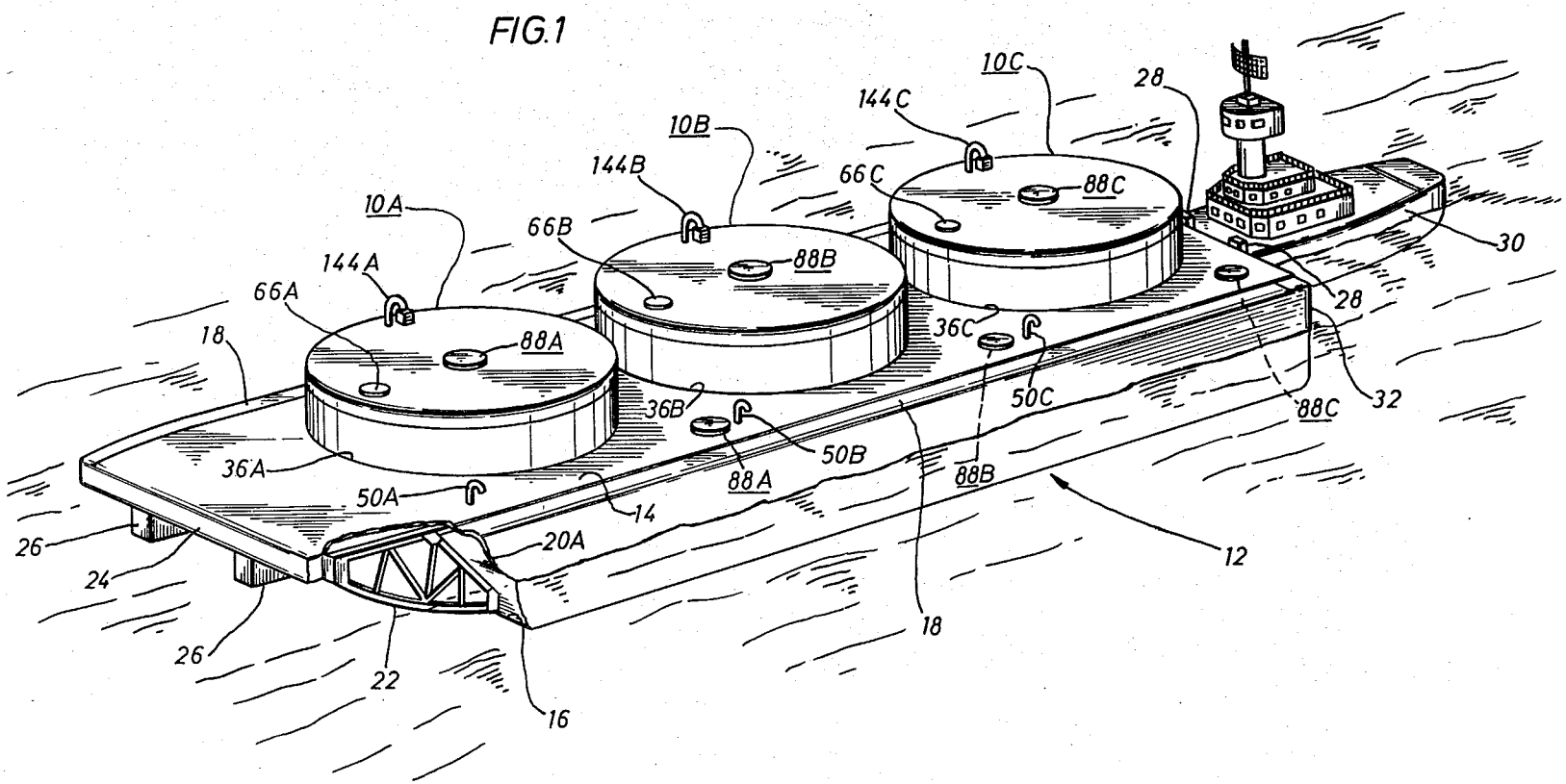
FIG. 1 is a generalized pictorial representation of a waterborne cargo transport vessel adaptable for use with a cargo transport system embodying the teachings of this invention, with a portion removed for clarity.

Throughout the following description, similar reference numerals refer to similar elements in all figures of the drawings.

Figure 2:
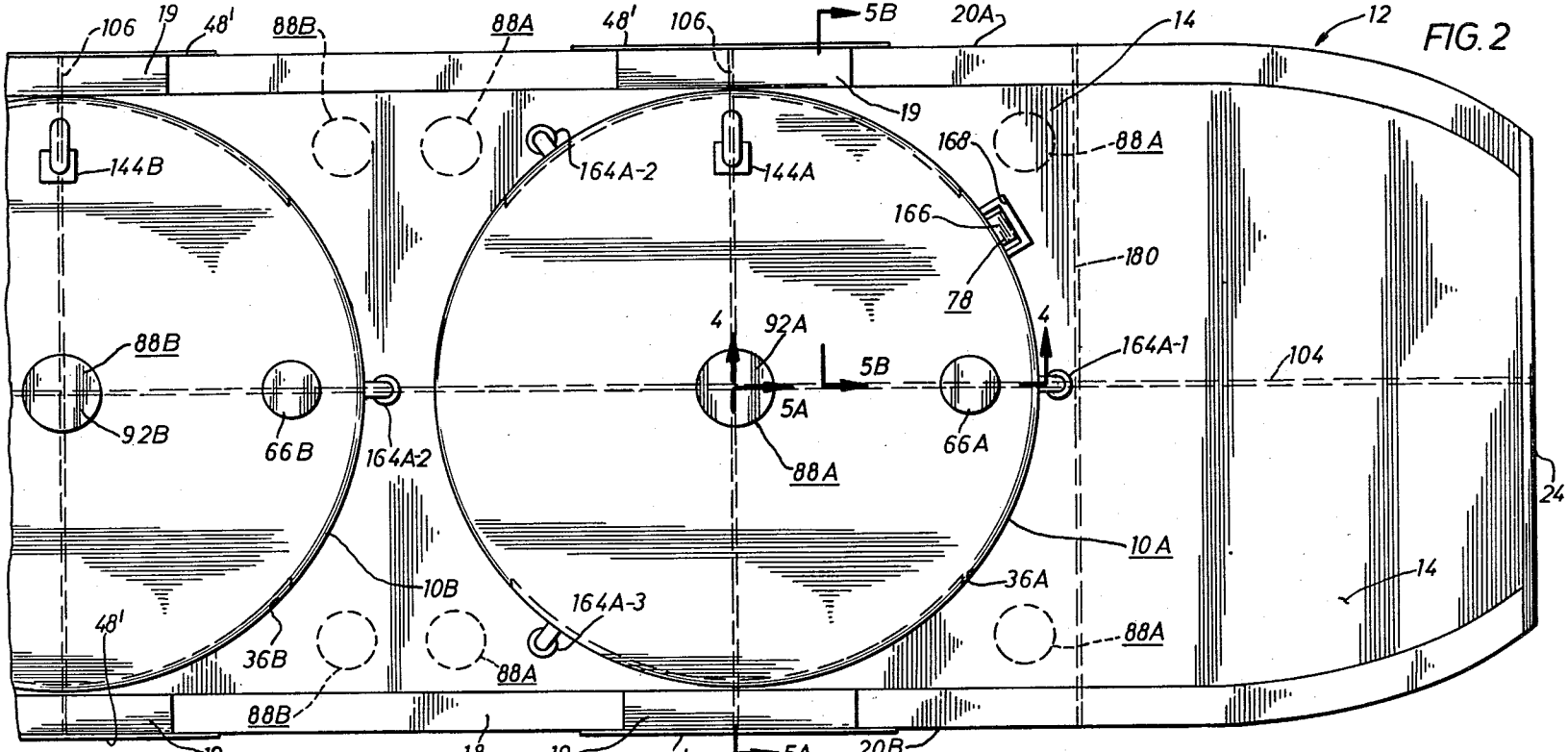
FIGS. 2 and 3 are, respectively, a plan view and a side elevational view of the generalized waterborne cargo transport vessel shown in FIG. 1.
Figure 3:
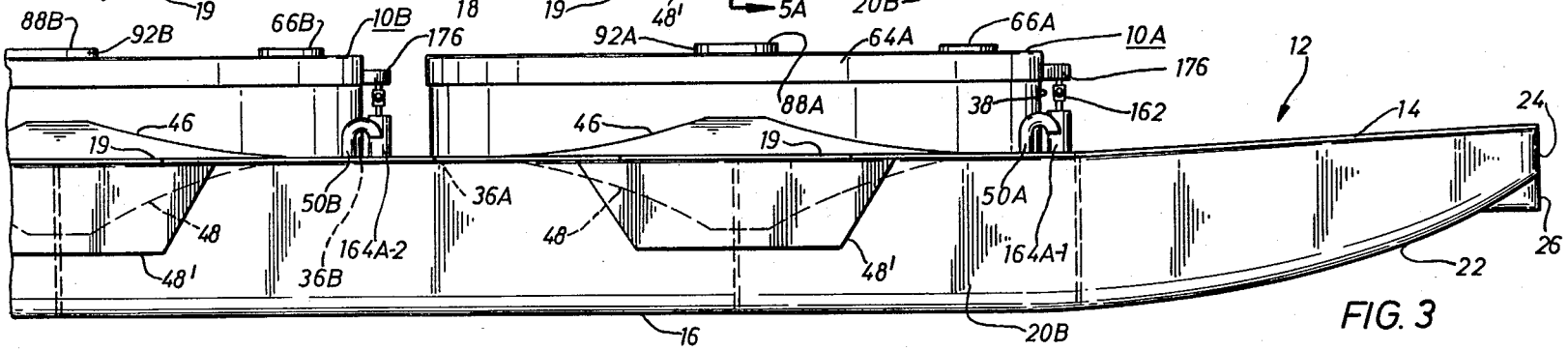

With reference to FIGS. 1, 2 and 3, illustrated is a pictorial representation of a cargo transport vessel, as a barge, generally indicated by reference numeral 12. The barge 12 has a plurality of cargo transport systems 10A through 10C mounted thereon, each cargo transport system 10 being in accordance with the teachings of this invention. The barge 12 has an upper deck 14 and a bottom 16 disposed beneath the surface of the water. A deck stringer 18, a heavy longitudinal insert into the deck plates, is provided. The stringer 18 is further thickened in areas where the coaming is close to the side-shell, as at 19. Although in the figures the upper deck 14 appears as substantially planar, it may exhibit "sheer" and "camber". That is, it may be curved from bow to stern and also curved from port to starboard, respectively, for purposes of protecting against waves and/or facilitating water runoff. Similarly, the bottom 16 may exhibit "deadrise" as is appreciated by those skilled in the art. The upper deck 14 and the bottom 16 are connected by side shells 20A and 20B, only one such side shell 20A being visible in FIG. 1.

The deck 14 and bottom 16 are terminated by square and/or curvilinearly and/or rectilinearly raked ends. The raked end 22 shown in FIG. 1 (with a portion removed to illustrate the skeletal framework) is provided with a vertical headlog plate 24 usually a foot or more in height. The raked end 22 may also be provided with tow knees 26 adapted to match the pushing knees 28 of a push boat 30. Both the forward and aft ends of the barge 12 may be squared box ends, both may be raked, or, as shown in FIG. 1, may have one raked end 22 and one squared end 32, dependent upon the location of the barge in an interconnected string of barges, or "two".

The upper deck 14, the bottom 16 and side shells 20 are fabricated of steel plates which may be suitably supported by stiffeners, bulkheads, and trusses in accordance with accepted practice in the art. Motive force for the barge 12 is provided by the push boat 30 acting against the headlog, tow knees, or box end of the trail barge of the tow. It is understood that it is within the contemplation of this invention to provide a cargo transport system 10 that is applicable to barges of the self-propelled type. Further, it is to be appreciated in the discussion that follows that the cargo transport system 10 embodying the teachings of this invention is equally applicable to onshore transport facilities, particularly rail or truck transit. Any predetermined number N of cargo transport systems 10 in accordance with the invention may be received on a given barge or suitable on-shore carrier. In the barge 12 illustrated in FIG. 1, it is seen that three cargo transport systems 10 embodying the teachings of this invention are serially disposed, one behind the other, along the length of the barge 12. The barge 12 may be conveniently provided in lengths between approximately 150 to 300 feet, with any predetermined number of appropriately sized cargo transport systems 10 provided thereon.

In accordance with the invention, the deck 14 has deck openings 36 therein, the number of deck openings 36 corresponding to the number of cargo transport systems 10 carried by the barge 12. (In FIG. 1, deck openings 36A–36C are shown, while in FIGS. 2 and 3, deck openings 36A and 36B are illustrated). The deck openings 36A–36C as illustrated are provided in the deck 14 to receive the containers of the cargo transport systems 10A–10C, respectively. The deck openings 36 may exhibit any predetermined cross-section configuration (in a plane substantially parallel to the deck 14) dependent, of course, upon the cross-section configuration (taken in the same plane) of the container of the cargo transport system 10 disposed therein.

Each deck opening 36 is fitted with an upstanding coaming 38 extending a predetermined distance 40 above the deck 14. In accordance with the invention the material of the coaming 38 is extended below the deck 14 for a predetermined distance by a continuous sleeve 44 (FIGS. 4 and 5). The coaming 38 and the sleeve 44 are each provided with strengthening inserts 46 and 48, respectively (as shown in FIG. 3). The inserts serve to mitigate for the loss of deck steel, which may also be mitigated by inserts 48' into the upper portion of the sideshell 20 and into the upper portion of wing bulkheads (if any). The predetermined distance 40 is a substantial portion of the interior depth of the barge 12 below the deck 14 and above the framing supporting the bottom plating 16 or an inner bottom, if any. Vents 50 are also provided. The sleeve 44 serves as a guide for a container 52 as the container 52 moves from a first, lowered, position to a second, elevated position and also restrains the container when locked into any position.

In accordance with the invention the continuous sleeve 44 is closed by a bottom closure generally indicated by reference numeral 54. The coaming 38, the sleeve 44 and the bottom closure 54 cooperate to form the continuous shell of a cargo receiving receptacle sized to receive the container 52 in the lowered position. When the container 52 is in the elevated position, the enlargement volume generated by the movement of the container 52 defines a separate cargo receiving volume 58 (FIG. 4B). It may be appreciated by those skilled in the art that if an inner bottom 60 is provided in the barge structure, the inner bottom 60 may automatically form the bottom closure 54 of the receptacle.

In the general case, the bottom closure 54 extends at least between the side boundaries of the receptacle, whether the side boundaries are defined by the sleeve 44 (FIG. 4B) or by the wing tanks or by the barge side shells (FIGS. 9, 11, 12 and 13). If the bottom closure 54 extends beyond the side boundaries of the receptacle so as to form a separate tank, it may then be referred to as a "tank top" or inner bottom 60. Throughout the remainder of this application, the bottom closure 54 will be understood to be an inner bottom 60. With regard to FIG. 5A, it is noted that the inner bottom 60 (forming the bottom closure of the sleeve) extends to the sideshell 20A. It is, of course, understood that brackets may be used between the side of the bottom closure 54 and the sideshell 20, if desired. In some cases, the bottom closure 54 may be omitted in which case cargo will intermingle with the bottom framing.

In accordance with the modification of the invention shown in FIGS. 9–14, the guide function is performed by either a perforated sleeve (FIG. 13) or by a series of vertical guide rails 192 (FIG. 11) disposed about the periphery of the deck opening 36; in this modification of the invention, the cargo-receiving receptacle is defined by a portion of the stiffened plating of the barge structure. In the modified embodiment of the invention shown in FIGS. 9–14, when the receptacle receives the container 52 in the lowered position, a residual volume is defined above the residual area between the interior of the receptacle and the exterior of the container 52. In this case, the cargo-receiving volume 58 is defined by the enlargement volume combined with the residual volume. (See FIG. 10).

In accordance with the invention, the cargo transport system 10 includes the container 52 movable with respect to the receptacle (and to the deck 14) from a first, lowered, position to a second, elevated, position. The container 52 defines, on the interior thereof, a cargo-carrying volume 62.

In the first, lowered, position the container 52 occupies a predetermined portion of the volume of the receptacle. (In accordance with the invention shown in FIGS. 4 and 5, the container 52 occupies substantially the entire volume of the receptacle. In the modification of the invention shown in FIGS. 9, 10 and 11, the container 52 occupies approximately three-fourths of the cross-sectional area of the receptacle).

In the second, elevated, position the container 52 is lifted vertically upwardly to define the cargo receiving volume 58 within the receptacle.

The invention is believed advantageous in that it defines a cargo transport system adapted to provide a separate, commercially-significant, cargo receiving volume 58 on the interior of the receptacle in which the container 52 is disposed. In accordance with the invention, when the receptacle receiving the container 52 is defined by a continuous sleeve and a bottom closure (FIG. 4B), the separate cargo receiving volume 58 is defined by the interior of the sleeve and bottom closure (.e., the inner bottom) cooperating with the exterior of the container 52. In accordance with the modification of the invention shown in FIGS. 9–14, the separate cargo receiving volume 58 is provided by the enlargement in volume generated when the container 52 is elevated taken in combination with the residual volume. This combination of the enlargement generated by the container and the residual volume is commercially attractive and useful, whereas the residual volume alone is not.

The separateness of the cargo volumes 58 and 62 provided by the invention is believed commercially advantageous in that it permits carriage within the same carrier space of two dissimilar cargos without risk of intermingling or contamination.

The container 52 is provided with a cover 64 enclosing the open top thereof. Suitable weatherproof cargo access hatches 66 are disposed in the cover 64 to permit introduction of a cargo into the cargo carrying volume 62 on the interior of the container 52. Manholes or hatches (as at 88) may also be provided to facilitate entry into and exit from the container 52 by maintainance personnel.

Suitable means generally indicated by reference numeral 72 for lifting the container 52 from the first to the second position are connected at predetermined locations about either the container 52 or the cover 64. The lifting means 72 may take anyone of a number of forms, as appreciated by those skilled in the art. For example, the lifting means 72 may be implemented by rack and pinion elements (as at 152 and 154 in FIG. 4), hydraulic ram elements (as at 164 in FIGS. 2, 3 and 16), or winch and wire line elements (as at 218 in FIG. 15). Of course, any suitable arrangement for lifting the container 52 from the first to the second position (and return to the first position) lies within the contemplation of this invention.

Figure 8:
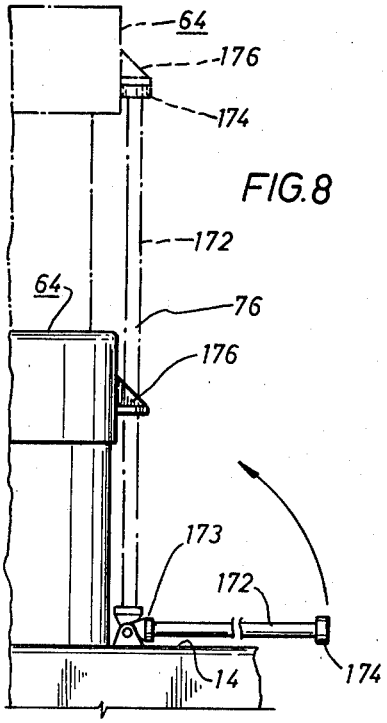
FIG. 8 is a schematic illustration of a locking arrangement used to secure the container in the second, elevated, position.
Figure 7:
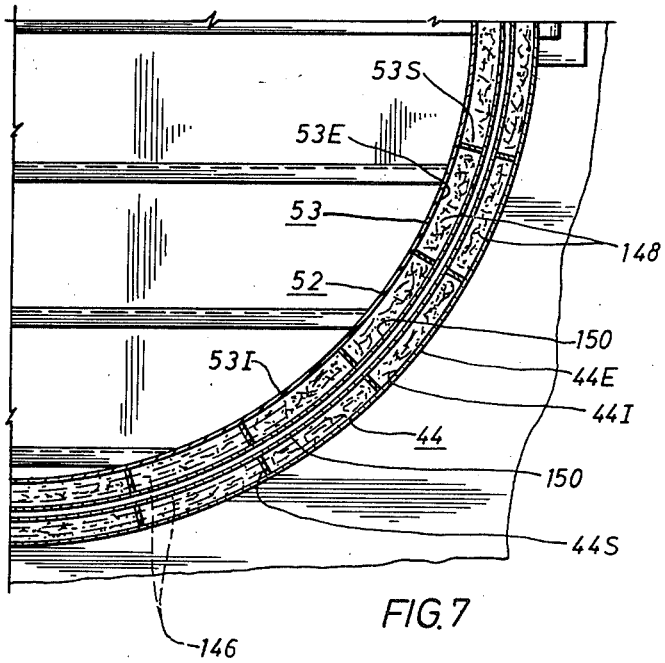
FIG. 7 is an enlarged sectional view taken along section lines 7—7 in FIG. 4A illustrating the disposition of insulating material about the container.

As discussed in connection with FIGS. 15 and 16, suitable means 74 are provided for synchronizing the operation of the elements forming the lifting means 72 to maintain parallelism between the bottom of the container 52 and a reference datum, usually the surface defining the bottom of the receptacle. To assist in controlling free surface effect in the cargo carried within the cargo receiving volume 58, a lock arrangement 76 for securing the container 52 in the second, elevated, position is also provided. The lock arrangement 76, in accordance with this invention, may take the form of a pawl 170 (if the rack and pinion constitute the lifting means 72), a hinged boot 178 (if the hydraulic ram is used as the lifting means), or, in any event, a strut arrangement 172, of adjustably fixable length with reference to both tension and compression (shown in FIG. 8). Indexing guides 78 are arranged to maintain the container 52 and the associated lifting means 72 in proper alignment.

In some instances, the lifting means 72 may not be physically disposed on the carrier (e.g., the barge 12). Accordingly, it is understood to be within the contemplation of this invention to dispose connection means 80 on the container 52 (or the cover 64 thereof) for receiving or engaging a lifting arrangement disposed at a location other than on the carrier having the cargo transport system. For example, the connection means 80 may comprise pad eyes 82 (FIGS. 15 and 19) adapted to receive a hook, grapple or other lifting element. Of course, any suitable elements adapted to receive or be engaged by a lifting element lies within the contemplation of this invention as the connection means 80.

The exterior of the container 52 is received in a close-fitting relationship with the coaming 38. A suitable seal arrangement 84 (FIG. 6) is provided to exclude water and debris from entering the receptacle through the container/coaming interface.

A cargo access arrangement 88 is provided for introducing and removing cargo from the cargo receiving volume 58 defined on the interior of the receptacle. When the receptacle is defined by the coaming 38, sleeve 44, and the inner bottom 60 (FIGS. 4 and 5), the cargo access arrangement 88 takes the form of an encased shaft 90 (FIGS. 4A and 4B) extending through the cargo carrying volume 62 defined on the interior of the container 52 and communicating with the cargo receiving volume 58. The shaft 90 is provided with a weathertight cap 92. In the modification shown in FIGS. 9 through 14 where the stiffened plating of the barge structure defines the receptacle, the cargo access arrangement takes the form of cargo access hatches 96 (similar to the hatches 66) or hatches 186 (FIG. 11) provided through the deck 14 in communication with the cargo receiving volume 58.

The structural details of a cargo transport system 10 in accordance with one modification of the invention are illustrated in FIGS. 4 through 8, to which reference is invited. It may be observed that since the invention is generally symmetrical about either the transverse or longitudinal centerlines of the container 52, the symmetrical structures are omitted from the appropriate Figures for economy of illustration. It is further noted that certain details described herein may only be illustrated in selected ones of the drawings, again for economy and clarity of illustration.

As seen in the Figures, the upper deck 14, bottom 16 and side shells 20 are fabricated of suitably affixed (as by welding or otherwise) steel plates. The plating of the deck, bottom, and sideshells is provided with suitable stiffeners 14S, 16S, and 20S, respectively, in accordance with accepted fabricating practices in the barge art.

As discussed above and as seen in the Figures, each container 52 in each of the cargo transport systems 10 on the barge 12 is received within the appropriate opening 36 provided in the deck 14. Each opening 36 corresponds to the geometric configuration of the container 52 used in the cargo transport system 10. Although the openings 36 are circular and the containers 52 are shown as right circular cylinders, any convenient geometric configuration may be used. It is emphasized and appreciated that the cargo transport system 10 in accordance with the teachings of this invention may be adapted for use in both waterborne and on-shore environments. The openings 36 may, therefore, correspond to openings provided in a barge deck, if in a waterborne environment, or to the upper surface of a railroad boxcar or truck if used in conjunction with an on-shore cargo transport arrangement.

As noted, the cargo transport system 10 may be disposed on a barge 12 which includes the coaming 38, fabricated of connected steel plates about the periphery of the deck opening 36. The coaming 38 may, if desired, be substantially coplanar with the deck 14 (e.g., FIGS. 12 and 13) or may extend the predetermined distance 40 thereabove. The material of the coaming 38 is extended below the deck 14 by the sleeve 44, which is joined at its lower end to the inner bottom 60. The inner bottom 60 (which forms the bottom closure 54, as noted) has a plurality of bottom plates suitably attached to each other, as by welding. The bottom plates define interior surfaces 60I and exterior surfaces 60E. The plates of the inner bottom 60 are stiffened by suitable stiffener elements 60S located on the exterior surface 60E. (It is also within the contemplation of this invention to provide stiffeners 60S on the interior surface 60I of the plates of the inner bottom 60).

The sleeve 44 is fabricated of a plurality of steel plates suitably attached to each other, to the bottom plates and to the coaming 38 near the deck by any suitable means, as by welding. In a manner analogous to the fabrication of the coaming 38, the sleeve 44 defines interior surfaces 44I and exterior surfaces 44E. The sleeve 44 may be provided with vertical stiffeners 44S, (typically flat bar stiffeners) and/or horizontal ring stiffeners (not shown). If stiffeners are provided, they may be disposed on the interior surface 44I or on the exterior surface 44E (FIGS. 4 and 7) of the sleeve 44. It is also noted that stiffeners for the sleeve 44 may not be required.

In FIGS. 4 and 5, the coaming 38, the sleeve 44 and the inner bottom 60 cooperate to define the receptacle in which the container 52 is disposed and within which the cargo receiving volume 58 is defined when the container 52 is moved to the elevated position (FIG. 4B). The receptacle as defined in FIGS. 4 and 5 is supported away from the plating of the bottom 16 by the cooperative interaction of the plates of the bottom, sleeve and deck; by the stiffeners 14S, 16S, 20S, 44S, and 60S; by webs 98; and any longitudinal and transverse bulkheads 100L and 100T, respectively, and any trusses 102 that may be incorporated into the framing system in the vicinity of the receptacle. The cooperative interaction of the above-mentioned elements implement the transfer and consequent balancing of the upward reaction forces against the downward forces of the weight of the structure, appurtenances and cargo along the length of the previously mentioned box beam (or "hull girder" as it is often referred to in the art). It will be appreciated that dynamic forces due to various accelerations in the motion of the transporting unit (i.e., barge, rail car, or truck) are also transferred and balanced through the cooperative interaction of the elements of plate, stiffeners, webs, bulkheads, and trusses with the main beam or hull girder.

A watertight centerline longitudinal bulkhead 104 (FIGS. 2, 4A, 4B, 5A, and 5B) is also provided. Transverse water-tight bulkheads 106 (FIGS. 2, 4A, 4B and 5A) define water-tight compartments between adjacent cargo-transport systems 10. Alternatively, if desired, the watertight bulkheads (as at 180 in FIG. 9) can be modified for location between adjacent cargo transport systems 10. As specifically shown in FIG. 4A, the bulkhead 106 may be on the transverse centerline of the sleeve 44. It is, of course, to be realized that any suitable support arrangement whereby the receptacle is supported within the barge 12 lies within the contemplation of this invention.

It will be appreciated that the vector sum of the upward support forces is exactly equal to the vector sum of the weights (i.e., the cargo, structure, appurtenances, and bilge, and/or ballast) and vertical accelerating forces. However, the elements of the upward support forces are not disposed exactly equal and opposite to the corresponding elements of the downward forces; this condition partially accounts for the multiplicity of cooperatively interacting structural elements. It will be apparent to those skilled in the art that the noncolinearity of the elements of downward force and the elements of upward force causes shearing stresses and bending stresses in the cooperatively interacting structural elements and that the various structural elements are sized by considerations that include these principles.

As mentioned, receivable in a close-fitting relationship within and vertically movable with respect to the deck 14 and to the coaming 38 is the container 52. The container 52 is fabricated of welded bottom plates 51 having an interior surface 51I and an exterior surface 51E thereon. Attached to the bottom plates 51 are sidewall plates 53, the sidewall plates 53 having an interior surface 53I and an exterior surface 53E thereon. The exterior surface 51E of the bottom plates 51 is provided with stiffeners 51S. The stiffeners 51S are shown to extend substantially perpendicular to the direction in which the stiffeners 60S on the plates of the bottom 60 extend. This arrangement serves to minimize heat transfer across the stiffeners if heated cargo is involved. It is also appreciated that pads of insulating material (shown in FIG. 4B at numeral 108) may be affixed at predetermined locations so as to be interposed in any potential heat transfer path across the stiffeners. Furthermore, the interior surface 51I of the plates 51 of the container 52 has a plurality of webs 51W which extend substantially perpendicularly to the direction in which the stiffeners 51S extend. An opening 110 is provided in the plates of the bottom 51 (FIG. 4B). The sidewall plates 53 may be provided with stiffeners 53S which may extend vertically and/or circumferentially about the exterior surface 53E. The stiffeners 53S may alternately be disposed on the interior surface 53I of the sidewall plates 53.

If required, the container 52 is provided with the cover 64. The cover 64 includes a bottom plate 63 having an opening therein. The bottom plate 63 is provided with stiffener members 63S. Spaced a predetermined distance above the bottom plate 63 is an upper plate 65 itself provided on its lower surface with stiffeners 65S. These stiffeners 63S and 65S extend substantially parallel one with the other. The upper plate 65 has an opening provided therein. The openings in the bottom plate 63 and the upper plate 65 align and register with each other and with the opening 110 provided in the bottom plate 51 of the container 52. An array of webs or girders 67 is provided between the bottom plate 63 and the upper plate 65 and extends substantially perpendicular to the stiffeners 65S and 63S, respectively, and substantially parallel to the webs 51W. When advantageous for economy of strength providing materials, it may be desirable to interconnect selected webs 51W and 67 by diagonals and/or vertical stanchions thereby forming a truss. As seen from FIG. 3, selected ones of the array of girders 176 extend past and outwardly between the upper and bottom plates and are attached to the hydraulic ram elements 164 which may form the lifting means 72. Alternately, as seen in FIG. 16A, individual ones of the rams may be connected by a header 228. The bottom plate 63 is suitably attached, as by welding, to the upper edges of the sidewalls 53 of the container 52. As noted, cargo hatches 66 are provided through the cover 64.

The cover 64 has a downwardly extending flap or flange 112 thereon which overlies a portion of the coaming 38 as a guard against spray or rain water running off the cover down the sides of the container 52. The flange 112 extends downwardly from the upper plate 65 of the cover 64 and cooperates with the coaming 38 to define a labyrinth seal which prevents water or foreign matter from entering the space between the coaming 38 and the container 52. It is noted that the labyrinth seal is mainly effective when the container 52 is in the lower position. The labyrinth can be made effective throughout the full range of travel of the container 52 whenever dimensional arrangements permit the height 40 of the coaming 38 and also the effective height of the flange 112 to exceed the range of travel of the container 52. An accordion-type seal will also give protection over the full range of travel despite a short flange 112.

To afford further protection over the full range of container travel, regardless of the height of the coaming 38, the seal arrangement 84 is provided (FIG. 6). The seal 84 preferably includes an upper and a lower seal member, 114U and 114L, respectively. A drain tube 116 is disposed immediately above the lower seal 114L so that moisture or foreign matter passing through the upper seal 114U may be shunted to the exterior of the coaming 38. It is, of course, understood that any suitable seal arrangement may be utilized and remain within the contemplation of this invention. For example a seal arrangement known as a bellows or accordion seal may be disposed between the overhanging flange 112 and the coaming 38 and/or the deck 14 to afford protection over the full range of travel of the container 52.

The cargo receiving volume 58 (FIG. 4B) is accessible through the encased shaft 90 extending centrally and axially through the cargo carrying volume 62 defined on the interior of the container 52. Of course, the shaft 90 may be disposed other than centrally and axially of the container 52, and, if desired, more than one shaft may be utilized. The encased shaft 90 communicates with the receiving volume 58 through the opening 110 defined in the bottom plating 51 of the container 52. The upper portion of the encased shaft 90 extends through the registered openings provided in the bottom and upper plates 63 and 65, respectively, of the cover 64. The encased shaft 90 is, as noted, provided with a suitable cap 92. Seals 118 may be used to prevent the entry of foreign matter and moisture into the encased shaft 90.

In addition to the cargo hatches 66 provided in the cover 64, in some instances means generally indicated by reference numeral 120 for loading and unloading material to and from the cargo carrying volume 62 on the interior of the container 52 is provided. The means 120 may include a submersible pump 122 provided adjacent a flue 124 which draws material carried within the cargo carrying volume 62 into an enclosed conduit 126. The flue is disposed above a sump 125. The conduit 126 extends through openings provided in the bottom plate 63 and upper plate 65, respectively, of the cover 64. A suitable drive arrangement 128 for the pump 122 is provided at a convenient location and an outlet control valve 130 is also disposed to control access into and out of the loading and unloading means 120. If a foot-valve 132 is used, the loading and unloading means 120 is opened only during the unloading of the cargo. It may be desirable in some instances to provide alternate means 136 for loading material into the interior of the cargocarrying volume 62 in the interior of the container 62. For this purpose a conduit 138 extends through openings in the lower plate 63 and upper plate 65 of the cover 64 (the upper plate being provided with a fitting 140). Access to the conduit 138 is controlled by a suitable valve 142. It is understood that either or both of the loading means 120 and 136 may be provided in any container 52 to permit loading and unloading of cargo therefrom. Good practice dictates that any generally enclosed volume be vented to atmosphere through vents disposed a substantial distance above the water line. The disposition of the vents is well known in the art and are typically illustrated at 50 in FIGS. 1 and 3 and at 144 as in FIGS. 1, 3 and 4B. As is known to those skilled in the art, special appurtenances such as flame arresting heads, pressure-vacuum valves and the like may be included.

The container 52 may have heating coils 146 (illustrated in dot-dash lines in FIG. 4A) through which a heating medium, as hot oil or the like, may flow to thereby maintain the cargo`therein at an elevated temperature. Of course, electrical heating coils, hot water, or steam may also be used to heat the container 52.

The container 52, the sleeve 44, and the coaming 38 may be provided with suitable insulating material 148 disposed in predetermined locations thereon in accordance with the teachings of this invention. It may be appreciated that the insulation 148 may be provided on either the inside or the outside of the container 52 or on the inside or the outside of the sleeve 44 and the coaming 38 or any combination thereof or any effective parts of structure forming the receptacle. Accordingly, in FIGS. 4 and 7, the insulating material is shown disposed on the interior 44I and 38I of the sleeve 44 and coaming 38, respectively, and the exterior 53E of the sidewall 53 of the container 52. A thin-walled sheath 150 of high strength material may be used to prevent the insulation 148 from being scraped away and possibly contaminating the receptacle. The cover 64 will also be insulated, preferably between the bottom 63 and upper plate 65 thereof. In general, there is a commercially available material suitable to each of the various services intended; preference is given to those bases, cements, binders, and sheathings and/or coatings that are fireproof or fireresistent and chemically inert to the cargoes to be carried and incorporate least limitation and/or hazard to be guarded against by workmen.

In volumes that are not only vapor-tight but also whose boundaries are completely structurally supported, such as the spaces between upper and lower roof members 63 and 65 respectively, loose fill thermal insulators (that are granulated or fibrous) may be used; such insulators include rock wool, glass wool, slag wool, and products made from mica, asbestos, diatomeceous silica, and alumina silicate. These loose-fill materials may also be supplied and installed in vapor proof bags.

In volumes that are vapor tight (as by means of sealed sheathing and/or vapor barriers) yet may further require that the insulation exhibit compressive strength and/or dimensional stability (as on the inside or outside of the container or inside the coaming or sleeve), boards or blocks of insulating material such as glass foam, calcium silicate, and treated balsa wood may be installed. In the event of unusually stringent strength requirements the required strengths may be obtained by use of part treated balsa wood with the remainder made up of completely fireproof and inert material such as glass foam having dimensional stability but necessarily lesser strength than balsa wood.

In areas where a modest amount of vapor isolation is required together with some dimensional stability (as on the outer surfaces of tanks normally in contact with free air) insulation may be assembled into boards together with vapor barriers and outer weather protection from materials as described above cemented together with inorganic binders. Alternatively, and especially where the surfaces are non-rectilinear (as around valves), spray fiber or foam insulation suitable to the service may be used. The insulation may be covered with an abrasion and water resistent coating that may in turn be reenforced with a netting of fiber glass that saturates with and becomes a part of the coating. Components for several such insulation systems are produced by Spraycraft Corporation and sold under the trademark CERAMOSPRAY, CERAMOSPRAY BULK FIBERS, and CERAMO-COTE.

Preformed insulation components are available for some applications.

On areas that cannot be made sufficiently water tight and where the existing humidity and/or water and temperature conditions may cause condensation to take place within the insulation (and thereby reduce its effectiveness) a suitable foam type insulation and/or treated balsa wood may be used. Urethane foam is produced in sheets and blocks or may be sprayed on surfaces or may be generated in confined spaces. Glass foam and polystyrene foam are produced in sheets and blocks. Foam insulation is characterized by small, discrete non-interconnected air pockets. In foams other than glass foam the interstices between pockets are almost completely (but not entirely) sealed, leading to some small absorption and transmissibility of water and/or water vapor.

Glass foam is especially applicable in difficult cases. It is free from moisture retention (except on the surface where it can be eliminated by suitable coating); it is inert to all commercial products (except, of course, hydrofluoric acid); it is applicable to services of generally high temperatures; and it has relatively good compressive strength: because it is brittle, it is manufactured in blocks and sheets of modest but useful dimensions; one such glass foam is a product of Pittsburg Corning Company, sold under the trademark FOAMGLAS.

It will be understood that the various characteristics, including the limitations and hazards, of the multitude of combinations of bases, binders, cements, coatings, sheathings, thicknesses, method of application, and costs thereof are known to those skilled in the art and are given due regard when making a selection of insulating material.

It is noted that any of the above-mentioned four insulation options may be used singly or in any desired combination. Again, these insulating options are: Option A, insulation disposed on the exterior surface of the coaming and sleeve (or any other form of receptacle); Option B, insulation disposed on the interior of the coaming and sleeve (or any other form of receptacle); Option C, insulation disposed on the exterior of the container; and, Option D, insulation disposed on the interior of the container. The appropriateness of any single option or any combination thereof is dependent upon various technical and economic circumstances. Those circumstances believed most pertinent are set forth below.

Option A includes several advantages. The insulation is not easily damaged; but if damaged or if loosened it may be repaired without disturbing either cargo (i.e. cargo in the cargo carrying volume 62 on the inside of the container 52 or cargo in the cargo receiving volume 58). It is free from impact associated with loading dry cargo into the volume 62. External insulation is also free from scraping associated with unloading dry cargo and free from residual contamination of cargo, either dry, slurry, or liquid in the volume 62. Such insulation is a permanent part of the sleeve (or any other form or receptacle) as distinguished from the movable (and removable) container 52. In those applications where strengthening/stiffening members 44S are required on the exterior 44E of the sleeve 44, the strengthening/-stiffening members provide an already existing support for the insulation. However, it should be noted that thermal insulation located on the exterior of the sleeve (or any other form of receptacle) has a drawback because the aggregate of the conductivities of the thermal leakage paths is greatest here.

Insulation disposed in accordance with Option B, or interior surface 44I of the sleeve 44 (or any other form of receptacle), is advantageous in that it is a permanent part of the sleeve 44 as distinguished from the container 52 and it is in a better position for thermal insulation than Option A. However, in the case of Option B, it should be noted that such a disposition is disadvantageous due to the ease of contamination or damage. It is appreciated that the receptacle as defined in FIGS. 9 through 14 may be insulated in accordance with Options A and B.

Under Option C, insulation disposed on the outside surface 52E of the container 52 is free from damage due to scraping during unloading, and easily repaired. The repair operation can usually be organized so that repairs could be made without interrupting the transport system. With this Option, the insulation and/or method of protecting it is readily governable to suit cargo in the cargo receiving volume 58 with which it would be in contact. Further, it is in a better position for thermal insulation than Option A or Option B. When this Option is used, the accordion seal and the labyrinth seal with the high coaming 38 and the flange 112 alluded to above are most appropriate in combination with stiffening/guides that prevent rubbing.

Finally, insulation disposed according to Option D, that is, on the inside surface 52I of the container 52, is in the optimum position for thermal insulation, most readily governable to suit cargo in contact with it since it is on a removable container, and relatively easily repaired. The repair operation can be organized so that repairs could be made without interrupting the transport system.

It may be appreciated by those skilled in the art that the disposition of the insulating material 148 as described immediately above (in accordance with any Option and in either modification of the invention) provides for the insulation of the cargo carrying volume 62 within the independently movable container 52 such that efficient transport of elevated temperature cargos, such as heated asphalt and the like, may be obtained in a manner which is believed not satisfactorily obtainable with standard cargo transport apparatus of the prior art. Such a structure in accordance with the invention is believed to facilitate the transport of elevated temperature cargos with a minimum of heat loss. As a consequence, at the termination point of the transportation journey, to facilitate the pumping of the elevated temperature cargo from the cargo carrying volume 62, the requirements for additional heating are believed less than is heretofore necessary.

It should also be appreciated from the discussion given hereinabove that the provision of a cargo-transport system 10 in accordance with the teachings of this invention provides a cargo carrying volume 62 disposed on the interior of the container 52 that presents a substantially continuous and smooth surface. The relatively smooth interior surfaces, when maintained at an elevated temperature by the action of the heating coils 146 (FIG. 4A) and/or the insulation 148, permit more effective drainage of viscous cargo, as asphalt, than is believed possible with the prior art.

Figure 4A:
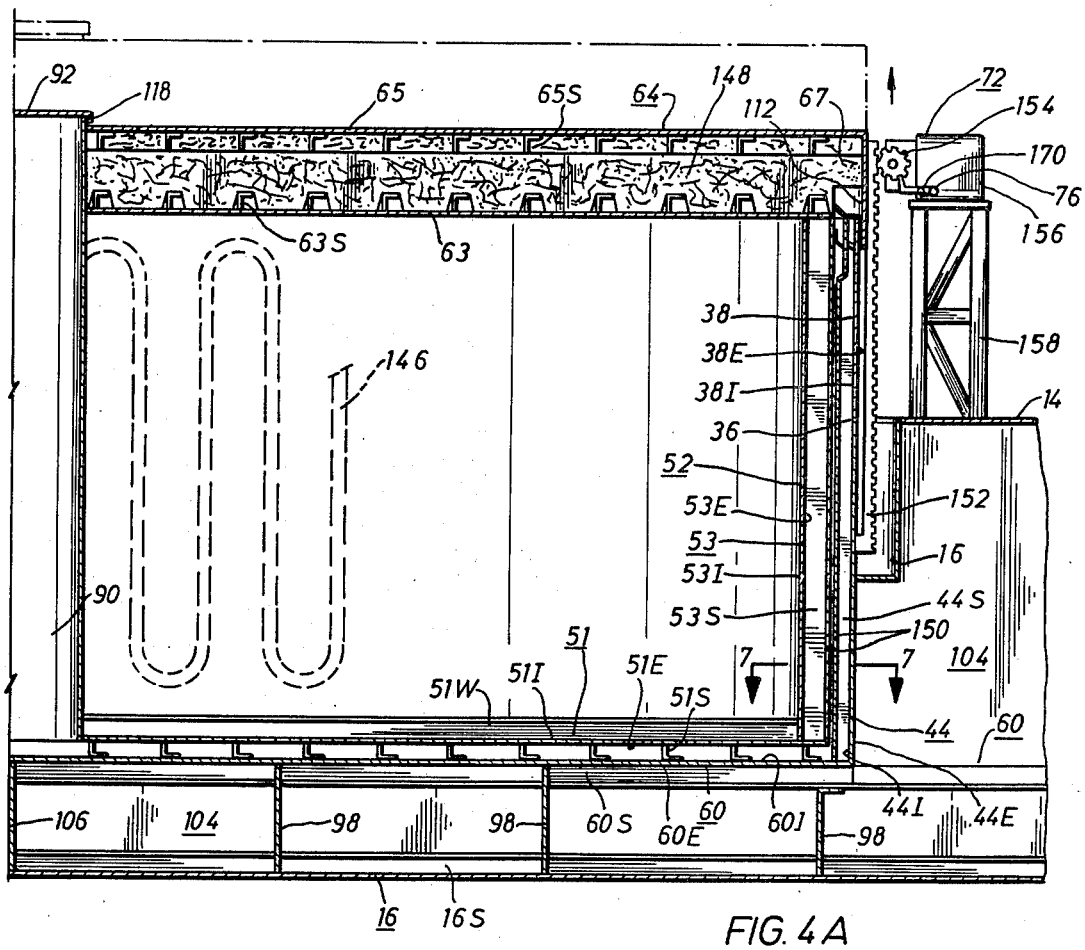
Figure 5A:
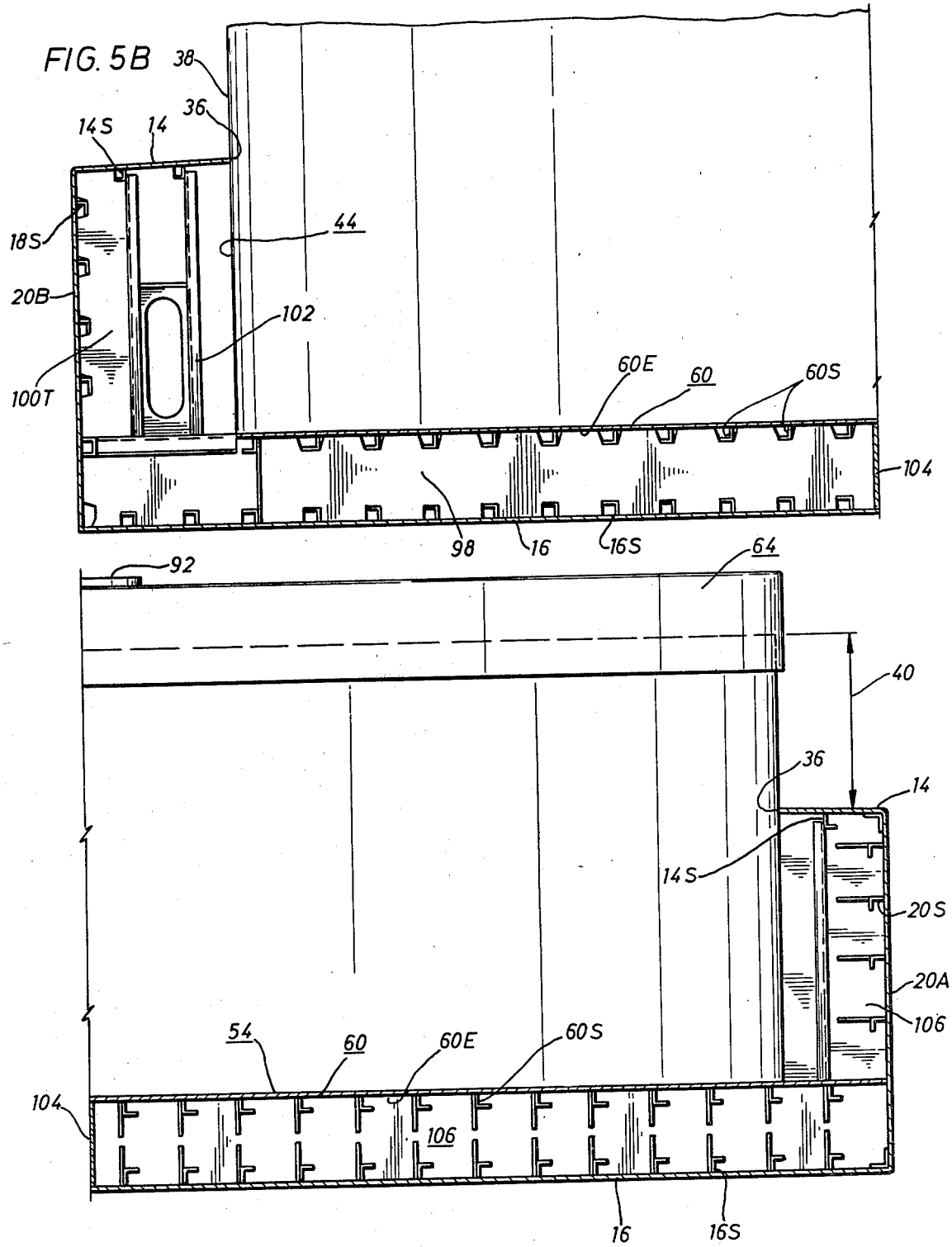

As discussed above, the container 52 is fit closely with the coaming 38 and the sleeve 44 and is movable with respect to the coaming 38 and the sleeve 44 from a first, lowered, position (in which it is nested within the sleeve 44 as illustrated in FIG. 4A) to a second, elevated, position (illustrated in FIG. 4B). With the container 52 in the second, elevated, position, the exterior surface 51E of the bottom plates 51 cooperates with the interior surface 60I of the inner bottom 60 and the interior surface 44I of the sleeve 44 to define a second, separate, substantially enclosed, cargo receiving volume 58 therebetween (FIG. 4B).

To effect the movement of the container 52 from the first, lowered, position to second, elevated, position, the lifting means 72 are provided. In FIGS. 4A and 4B, the lifting means 72 are shown to comprise a gear rack 152 and a pinion gear 154. The gear rack 152 may be attached to one of the projecting girders 67 while the pinion 154 and a suitable drive motor 156 driven by electricity, hydraulics, or air are supported on a stand 158 above the deck 14.

As will be discussed herein in FIGS. 15 and 16, suitable means 74 are provided to synchronize the operation of the lifting means 72 with the lifting of the container 52, by the use of appropriate servo mechanisms, hydraulic flow dividers, or any other suitable arrangement. In the lowered position shown in FIG. 4A, the gear rack 152 is received within a recess 160 provided in the deck 14 of the barge 12. The length of the gear rack 152 is at least equal with the desired elevation to which the container 52 may be raised.

Other equivalents may, of course, be utilized as the lifting means 72. These alternatives may comprise wireline devices (as in FIG. 15) or a hydraulic ram.

If a hydraulic ram arrangement is used as the lifting means 72, a suitable configuration therefor is shown in FIGS. 2 and 3. Each of three ends of roof girders 67 extending from the cover 64 are affixed at flexible junction points 162 to individual hydraulic ram elements 164. In the lifting arrangement shown in FIG. 2, three double-acting hydraulic ram elements 164-1, 164-2, and 164-3 are connected between the barge hull and the ends of each of the extending girders. The hydraulic rams 164 are located in predetermined locations disposed about the periphery of the cover 64. It is preferred that the number of flexible junction points 162 not exceed three, with the further limitation that, if structural and fabrication conditions permit, the junction points 162 be equiangularly disposed about the circumference of the container 52. However, if the equiangular arrangement is impractical, the rams 164 may connect at the junction points 162 as shown in FIG. 2, in which case either the effective ram piston areas or the operating fluid pressure (or both) will not all be equal.

A flexible connection at the junction point 162 may be a pendant, a universal joint, a ball and socket or any other suitable flexible connection. By the disposition of the flexible connection, secondary loads are prevented from being transmitted from the lifting means 72 into the container supporting beam in such a way that the beam is not distorted or fatigued. In most cases, it is understood that similar flexible connections may also be required at the lower ends of the rams.

It is again noted that in some instances (e.g., when a lifting arrangement is disposed at an "external" location other than on the carrier) it is desirable to provide connection means 80, such as pad eyes 82 or the like, for the purpose of receiving or engaging lifting elements located elsewhere than on the barge 12. For example, the pad eyes 82 may be used to receive hooks from a lifting crane disposed on-shore in proximity to a barge 12 having cargo transport systems embodying the teachings of this invention.

Indexing guides 78 are provided to prevent the rotation of the container 52 about a central vertical axis to thereby maintain the container 52 aligned with the lifting means 72. Suitable indexing guides 78 include a generally radially extending key 166 (FIG. 2) provided on the exterior surface 52E of the container 52 adapted to be received within a keyway 168 provided at a suitable height and of a suitable length. Of course, any suitable indexing guides 78 may be used and lie within the contemplation of this invention provided they are selected with reference to their effect on any thermal insulation which may be provided. (If, of course, the geometric configuration of the container 52 were a right elliptical cylinder, for example, an antirotation arrangement would inherently be present in the geometry thereof).

The locking means 76 for securing the container 52 in a predetermined position is provided in accordance with the invention. The locking means 76, in whatever form implemented, provides several major advantages.

First, the locking means 76 serves an economic advantage by permitting the utilization of relatively less expensive lifting means 72 and synchronizing means 74. With the provision of locking means of sufficient strength to support the weight and dynamic forces imposed on a fully loaded container, it is possible to size the lifting means and the synchronizing means so that they need only be able to raise an unloaded container to a desired elevation in the relatively calm environment of a loading dock or wharf.

Second, the locking means serves to protect against any creep or slippage present in the lifting means and synchronizing means. Thus, the container is secured in the desired position throughout the transit journey. As a corollary, the locking means maintains the container in a safe location during times when workmen may be required to enter into the receptacle.

Third, by being able to be loaded in compression and in tension, the locking means secures the container in a position wherein free surface effect is controlled. Synchronizing means 74, in whatever form used, inherently provides a temporary (in the sense of non-permanent) locking of the container 52 at the desired elevation. In the case of the lifting means 72 taking the form of the rack 152 and the pinion 154, a pivotally connected pawl 170 (FIG. 4B) may be utilized to engage a selected one of the teeth on the pinion 154 so as to secure engagement between the rack 152 and the pinion 154 to maintain the container 52 at the desired elevation.

If the lifting means 72 comprises the appropriately spaced hydraulic rams 164 (FIG. 2), a permanent locking means 76 may include a safety strut 172 (FIG. 8) having a head 174 thereon preferably pivotally disposed on the deck 14 and movable from a retracted to an extended position (shown in dot-dash lines in FIG. 8) in which the strut 172 is received beneath an extending beam 176 provided beyond the edge of the extending flange 112. Alternatively, the locking means 76 may include a hinged boot 178 (FIG. 16B) connectable about a projecting flange of the rams 164 to prevent the ram 164 from being retracted and thereby securing the container 52 in the elevated position. The hinged boot 178 may be suitably counterbored in its interior at each end, such counterbores to mate with extending flanges on the ram head and ram cylinder body to prevent extension at the ram and thereby assist the effectiveness of the container 52 in controlling the free surface effect of the material below it.

As discussed hereinbefore, the cargo receiving volume 58 is defined within the receptacle by raising the container 52 from the first, lowered, position (FIG. 4A) to the second, elevated, position (FIG. 4B) by the use of the lifting means 72 or the connection means 80 (if "external" lifting means are provided). The container 52 is secured in that location by the lock means 76. It is appreciated that the container 52 may be raised to any desired elevated position. It is also appreciated that the maximum range to which the container 52 may be elevated is not limited by the height of the coaming 38, although it is believed that the second, elevated, position would, in the most likely case, dispose the bottom 51 of the container 52 below the top of the coaming. For this purpose, it may be appreciated that the struts 172 comprising the locking means 76 (FIG. 8) may be of adjustable length to provide adjustability and flexibility in securing the inner container 52 in the desired elevated position. The struts 172 and their connectors should be capable of withstanding both compressive and tensile loads. Further, if hinged boots 178 are used as the locking means, various sized (length) boots are provided in various combinations to maintain the rams 164 extended to maintain container 52 in any of a predetermined number of selected elevated positions (as shown in FIG. 16B). It will be appreciated that each hinged boot 178 may be bolted or locked by other means to an adjacent hinged boot to provide a tension connection between the ram head and ram cylinder to provide performance in tension, if necessary, when acting to control free surface effect. This interconnection of boots cooperates with the mating flanges and counterbores (mentioned above) to complete the tension connection between the ram head and cylinder head. Thus, during transit, dependent upon the type of cargo disposed within the cargo receiving volume 58, the bottom surface 51E of the container 52 may be adjusted to rest upon that cargo. By adjusting the height of the container 52 so that the bottom plate 51 thereof is locked in a position at substantially the same height as the cargo, the stability of the barge 12 is enhanced since free surface effects and concomitant shifting of the center of gravity of the cargo is minimized. Alternatively, if desired, it is possible to maintain the container 52 clear of the cargo in the receiving volume 58 by the locking means 76.

To gain access to the cargo receiving volume 58 defined within the receptacle with the container 52 in the elevated position and to introduce cargo thereinto and extract cargo therefrom, utilization is made of the encased shaft 90. With the cap 92 thereof removed, an access way is obtained into the cargo receiving volume 58 through which cargo, as grain, coal slurry, cement or any other suitable cargo, may be introduced into the cargo receiving volume 58. It is noted that through the provision of such introducing means as the encased shaft 90, the necessity for disposition of the loading and unloading devices of the prior art is eliminated. As a further consequential advantage, the container 52 need be raised only to an elevation sufficient to define the cargo receiving volume 58 necessary to accommodate the volume of cargo being transported, thus defining a low-profile cargo carrier. Such low-profile provides a lower center of gravity and an enhanced visibility for the push boat 30 (FIG. 1), both being further advantages of the structure embodying the teachings of this invention. Of course, any other suitable means for introducing and withdrawing cargo from the cargo receiving volume 58 may be used. For example, for liquid and slurry cargo, pumps and conduits may be used. Dry powdery cargo may be introduced into and withdrawn from the cargo receiving volume 58 by a well-known technique which blows an air and cargo mixture through conduits. (Suitable dust collector systems may be used.) For dry cargos approximating the size of crushed rock, horizontal or inclined screw or belt conveyors may be used. Such conveyors may be used in conjunction with vertical screw or bucket conveyors. Of course, for extremely bulky cargo, the container may be temporarily removed.

It is understood that the introducing means 88 need not extend through the container 52 as in the case of the enclosed shaft 90. It is only required that the introducing means 88 communicate with the cargo receiving volume 58. Such communication may be implemented in any convenient manner as by appropriately shaping the bottom closure 54 of the sleeve 44.

The volumetric measure occupied by the encased access shaft 90 is related to the volumetric portion within the cargo carrying volume 62 on the interior of the container 52 by a number related to the square of the ratio of diameters of the shaft 90 to the inner dimension of the container 52. For example, and these are typical dimensions, if the outside diameter of the access shaft 90 is 4.5 feet and if the inside diameter of a right circular cylindrical cargo carrying volume 62 is 45 feet, the volume occupied by the access shaft 90 is 1/100 of the cargo carrying volume 62. It may furthermore be appreciated that this cargo carrying capability may be restored to the cargo carrying volume 62 by increasing the height of the sidewalls 53 of the container 52 by a distance equal to the fractional number above defined, here 1/100, multiplied by the effective sidewall height. The effective sidewall height is the height along the sidewall 53 reached by a cargo carried within the cargo carrying volume 62. For example, in the extreme case where the height of the cargo equals the basic height H of the sidewalls 53 of the container 52 (e.g., 15 feet), increasing the effective height by H/100 (i.e., by 0.15) feet would restore the cargo carrying capacity occupied by the shaft 90 to the cargo carrying volume 62 defined within the container 52. (The forward cargo transport system 10A (FIG. 1) due to its proximity to the rake 22, has a typical basic sidewall height of 13 feet). Of course, these dimensions are illustrative only, with any suitable dimensions for a cargo transport discussed lying within the contemplation of this invention. Thus the additional height required to be added to the container is functionally related to the loss of cargo carrying volume divided by the cross section area of the container at the point along the container reached by the cargo therein.

In the general case, it will be appreciated that a loss in cargo carrying capacity of a container of any shape can be compensated for by a relatively small increase in one or more inside dimensions of the container by taking into account the loss and consequent required restoration of the cargo carrying capacity. For some computations, it may be found useful to employ the weighted average cargo height defined as the average of the heights of the equal elements of cross section into which the cargo has been divided for convenience of computation.

It is further appreciated by those skilled in the art that the provision of right circular cylindrical geometry or other smoothly curved section for the sleeve 44 and container 52 substantially reduces stress concentration factors generated by thermal changes or transit conditions (such as waves or rail discontinuities) and is therefore believed further advantageous for this reason over the cargo transport structures of the prior art (that generally involve rectangular hatches). Because of the affixment of the coaming 38 and of the sleeve 44 to the deck 14, and because of their vertical dimension, the coaming and the sleeve may be fabricated of thicker insert plating 46 in those regions proximal to the sidewalls 20 where stress concentration factors are greater than one to thereby reduce this factor toward unity.

In FIGS. 9 through 14, a modification of the invention shown in FIGS. 4 and 5 is illustrated. FIG. 9 is a plan view of the barge, while FIGS. 10 and 11 respectively illustrate a perspective view of the volumetric relationship of the volumes defined in accordance with the transport system of FIG. 9 and a view of the container 52 in the elevated position. In accordance with the modification, the receptacle which receives the container 52 and defines the cargo receiving volume 58 is defined by the stiffened plates of the barge 12. Whenever possible, the smooth surfaces (i.e., the unstiffened sides) of the plates are in juxtaposition to the cargo receiving volume. The boundary of this receptacle, in the case of the modification, does not lie in a close, all-around, telescopically nested relationship (as is the case with the sleeve 44 and the container 52 in the FIGS. 4–5).

For the usual marine applications, the side boundary of the receptacle has the shape of a substantially rectangular (including a square) cylinder, whereas the side boundary (the sidewall 53) of the container 52 is preferably a right circular or right elliptical cylinder, as previously described. It is understood, of course, that in either form of the invention, the container 52 may have its side boundary in the form of a right rectangular or square cylinder, and may have other shapes such as rounded corners and variations from a flat level bottom, the latter variation to give better strength/weight ratio and for better drainage.

As seen in FIG. 9, a portion of the deck 14 is broken away to illustrate the receptacle within which is defined the cargo receiving volume 58. The receptacle is formed by the plating which forms the elements of a conventional support structure, those elements being the transverse bulkheads 180 at the fore and aft ends of the receptacle, and the wing bulkheads 182 (or the sideshells 20 when no wing bulkheads are provided) at the sides. It can be appreciated that the receptacle could be made separate from the barge support structure, but economy of material, in having the plating serve a dual purpose, dictates the preference for having a plating element perform double duty.

In the modification shown in FIGS. 9–14, a residual area 184 is defined about the container 52 when the container is in the lowered position within the barge. In FIG. 10, the residual area 184 and its relationship to the enlargement area is illustrated. The residual and the enlargement areas are related to the residual and enlargement volumes by the product of these areas and their respective heights. Because these heights may vary from case-to-case, it is believed more instructive to speak in terms of areas in the discussion which immediately follows. The residual area 184 is not available for storage of cargo in the receptacle previously described in connection with FIGS. 4–5 (i.e., the sleeve 44 and the inner bottom closure 60). The area defined in the receptacle (made up of the residual and enlargement areas) with the container 52 in the elevated position compared to the residual area (184), is defined by the relation:

$$LW/(LW-\pi D^2/4)$$

where W, L, and D are the dimensions, in consistent units, of the receptacle and the container as defined in FIG. 10. In the limiting case where $W=L=D$, the total area is approximately four and one-half times the residual area. In the limiting case, the area under the container 52 (the enlargement area) is approximately three-fourths of the receptacle area.

Thus, when the container 52 is elevated, as shown in FIG. 11, it may be appreciated that the receiving volume 58 is defined by the volume above the residual area 184 taken in combination with the enlargement volume defined above the enlargement area. The residual volume, which alone is commercially unattractive to use as a carriage volume, is thus enlarged by the addition of the enlargement volume generated by movement of the container 52, permitting the cargo receiving volume 58 to include substantially all of the receptacle volume when the container 52 is elevated. Thus, in accordance with the invention, a separate cargo receiving volume 58 of a commercial significant size is provided.

As seen in FIGS. 1, 9, and 11, the cargo receiving volume is accessible for loading and unloading through the cargo access arrangement 88. In FIGS. 9 and 11, the access arrangement 88 includes relatively small, watertight, high-coaming hatches 186 provided with caps 188. As a further modification, FIGS. 14A and 14B illustrate, in plan and transverse section respectively, a portion of the bottom of the receptacle wherein selected portions 190 thereof are locally sloped downwardly toward the area directly vertically under the hatches 186 to facilitate drainage.

FIGS. 9 through 11 may be said to generally represent a barge that is built to conventional depth/length ratios, about 1/16 for inland barges and about 1/14 for seagoing barges. For the barges of conventional depth, the container 52 will usually extend substantially above the deck 14 even when in the lowered position. It is good shipbuilding practice to provide a coaming 38 extending as high as possible under the cover 64 of the container 52; however, partly because the coaming 38 is generally not longitudinally continuous, the structural material of the coaming 38 does not function in completely efficient cooperation with the other material of the barge's/ship's hull girder.

Figure 12:
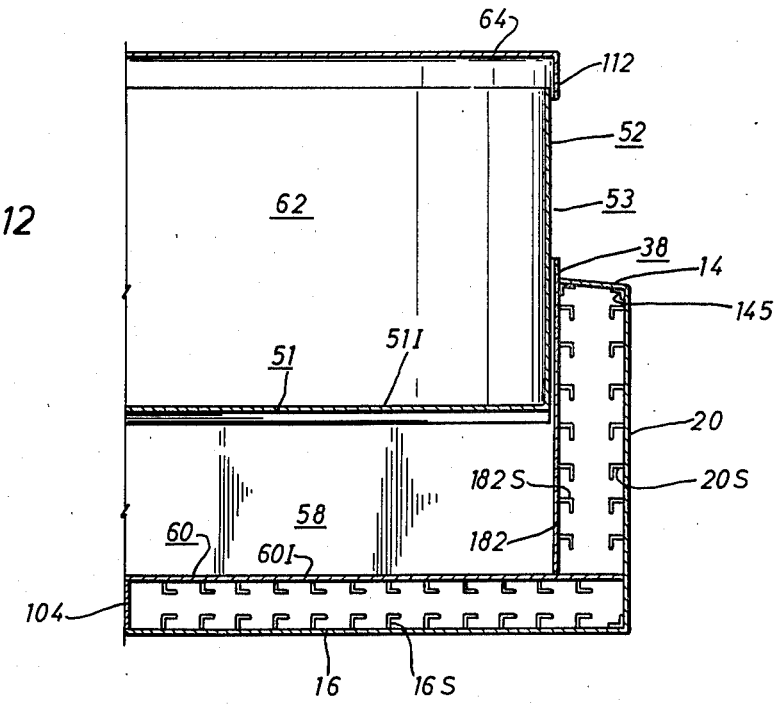
FIGS. 12 and 13 are views, substantially similar to the view shown in FIG. 11, with the container in the elevated position and illustrating possible structural configurations for the definition of the receptacle within the barge.
Figure 13:
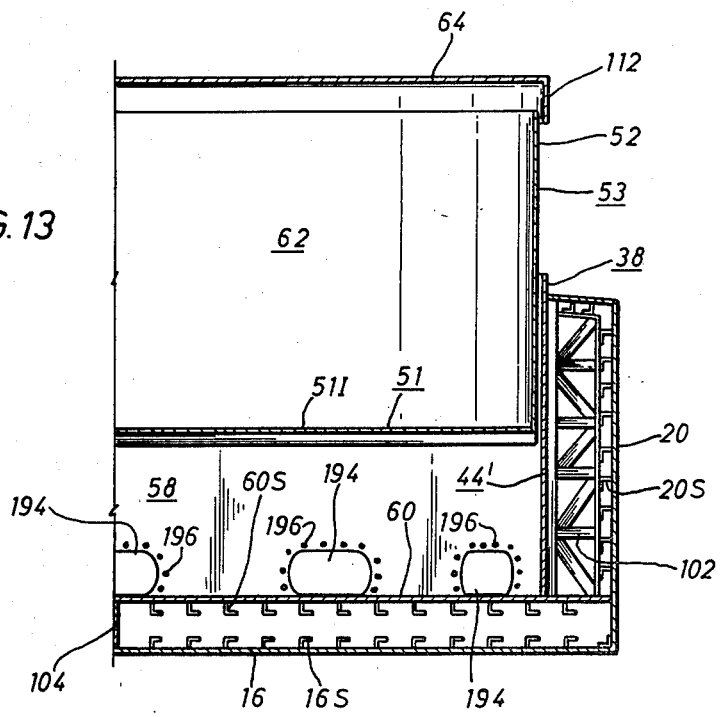

FIGS. 12 and 13 generally represent a barge or ship that is constructed to a depth generally greater than that required by conventional rules wherein the deck 14 is at an elevation substantially corresponding to the position normally occupied by the top of the coaming 38. By use of greater-than-conventional depth of hull, the high coaming 38 is eliminated and the material used contributes more efficiently to the hull girder.

FIG. 12 shows in section a barge having "wing-wall" type construction wherein the longitudinal wing bulkheads 182 cooperate with the side shell 20 of the barge to provide the shear-carrying webs of the hull girder. FIG. 13 shows in section a barge having no longitudinal "wing" bulkheads 182. The wing-wall type of construction is preferable where the conditions of high density cargo, need for greatest safety (especially against pollution), and severe service (such as open-sea service) prevail. Construction without the wing-wall is indicated for reasons of economy where the conditions of low-density cargo, absence of a pollution possibility, and moderate service prevail.

With the cargo transport system 10 in accordance with FIGS. 9–14, wherein the receptacle is not constructed in a close-fitting telescoping relationship with the container 52, the guiding function for the container 52 is provided by the continuous sleeve 44 or may be provided by the provision of vertically extending guide rails 192, shown for convenience in connection with the barge structure of FIGS. 9 and 11. The guide rails 192 are installed with approximately equal spacing around the periphery of the container 52, unless a convenient but unsymmetrical pattern of webs is available to which the guide rails 192 could be effectively and economically attached.

Generally, the minimum number of necessary guides 192 is three. Due to the right-angular relationship of the longitudinal hull girder with the transverse load-carrying bulkheads and webs, and due to the usual presence of a centerline vertical keel, web or bulkhead (to which guides may be efficiently attached), it is often most convenient to provide four vertical track rails, two fore-and-aft (on the centerline) and two transversely.

It will be apparent that when longitudinal or transverse bulkheads pass close to the container sides, such bulkheads may be fitted with the guide rails or other suitable guides and may be adequately strengthened to guide the container. When the nearest bulkhead forming a side of the receptacle is a substantial distance from the container, then the guide rails or other suitable guides may be supported by open trusswork (similar to the trusswork shown in FIG. 13).

Alternatively, the receptacle defined in accordance with the modification of FIGS. 9–14 may utilize a modified sleeve 44' (FIG. 13) substantially similar to the sleeve 44 discussed in connection with FIGS. 4–8, but differing in that the sleeve 44' is perforated to communicate with the residual volume of the receptacle. The sleeve 44' is provided with perforations 194. The perforated sleeve 44', extending as it does into the receptacle, may act as an antishifting enclosure to limit shifting of cargo carried in the cargo receiving volume 58 on the interior of the receptacle when the container 52 is in the elevated position. Shifting of the cargo, if unchecked, may cause the barge to take a severe, permanent heel or otherwise affect the stability thereof. An array of bolt openings 196 may be provided about the perforations 194 to facilitate the attachement of flanged covers (not shown) sized to close the perforated openings 194 to totally enclose the sleeve 44'. One reinforced opening with bolted cover may be provided for each sleeve 44 or 44' for entry and exit of loading machines, conveyor elements and the like. Such machinery would generally be electrically driven in this confined space, although other driving arrangements may be used, if desired. The cover plates may be appropriately insulated, if desired.

As mentioned earlier, to assist in control of free surface effect, it is desirable to synchronize the operation of the elements of the lifting means 72 which raise and lower the container 52 so as to maintain the container 52 coaxial with its guide arrangement, whether that guide arrangement be provided by the sleeve 44 to 44' (as shown in FIGS. 5 and 13, respectively) or by the guide rails 192 (as shown in FIG. 11) as the container 52 is raised or lowered. As also mentioned above, it is desirable to lock the container 52 at any predetermined position along the guides.

By insuring coaxial alignment, the outer surface of the bottom 51 of the container 52 is maintained in parallel relationship with the position last occupied thereby through each successive portion of its ascent and, thus, in parallel orientation with the surface defining the bottom of the receptacle, whether that surface be an inner bottom 60 or any other datum. That is to say, the individual elements of the lifting means 72 (whether defined by racks and pinions, winches, or hydraulic rams) are synchronized in operation to lift and lower the container 52 to maintain parallel alignment with the datum (usually the surface defining the bottom of the receptacle) during the lifting and lowering operation. Usually, of course, the parallelism is maintained with respect to the horizontal. Further, by making the support strut 172 in FIG. 8 both adjustable and able to take tension and compression in its operation, the above-mentioned locking consideration is satisfied when the strut is secured in its working position.

Of course, any arrangement of the lifting elements inherently provides a locking effect to maintain the container at a predetermined location along the guides. However, this locking effect is temporary in the sense that the effect diminishes over a period of time as a result of external and internal forces acting on the lifting arrangement. For example, wave action may be an external force which may affect the locking provided by the synchronized lifting elements. Internal forces may be the slackening of lines (if the winch arrangement of FIG. 15 is used) or the leaking of hydraulic fluid (if the hydraulic arrangement of FIG. 16 is used). To counteract these forces, a permanent locking arrangement, such as the strut 172 described in connection with FIG. 8, the hinged boot 178 shown in FIG. 16B, or a multi-toothed double-acting dog (not shown) matable with the gear rack 152, may be used to maintain and lock the container in the elevated position.

If the rack 152 and pinion 154 as shown in FIG. 4 are used as the lifting means 72, synchronous lifting and lowering and locking of the container 52 can be accomplished with the provision of a suitable synchronization system. One system useful for the rack and pinion includes a group of coupled shafts (not shown) that interconnect the pinion drive boxes and, consequently, assure that the racks are driven in synchronization. The functioning of the coupled shafts necessitates their arrangement in the form of an open polygon or curve. A polygonal arrangement may be achieved through the use of universal joints and/or bevel gears. The controlling shaft can take the form of an open curve by use of a control cable that is relatively compliant in bending and stiff in torsion. Only by way of example, a speedometer-type cable may be used.

If a block and tackle arrangement is used as the lifting means 72, a suitable synchronization and equalization system to stabilize and clamp the container 52 is shown in FIGS. 15A and 15B, which are, respectively, a plan and a side elevational view of a holddown winch synchronizing arrangement indicated by the general reference character 74. The winch synchronizing arrangement shown in FIGS. 15A and 15B acts to both lift-up and hold-down the container 52.

It will be appreciated that the container upon which the rack is mounted may not be able to withstand the forces and/or moments associated with the pressures occurring at the pressure angle between the rack and pinion. To obviate any difficulties in this regard, it may be necessary to dispose a force compensating arrangement in cooperation with the rack and pinion and rack and dog. This may take the form of a flange 197 (FIG. 20) attached to each side of the rack. The flanges cooperate with slides integral with the pinion housing 199 (or bolted to the support for the multi-toothed dog) through which the pressure angle forces are balanced. Alternatively, a single rack as shown may be replaced by a pair of racks and pinions (FIG. 21) mounted tangentially rather than radially to the container. The two racks will be disposed back-to-back and the pinions disposed oppositely of each other. With the alternative described, the reactions due to the gear tooth pressure angles cancel and do not react radially against the container.

The form of the synchronizing arrangement 74 shown in FIG. 15 includes a first and a second array of grooved Lebus drums 202 and 204, respectively. FIGS. 15A and 15B illustrate three drums in each array, although any predetermined number may be used. The drums 202A, 202B and 202C are connected through a common shaft 206 to a reduction gear arrangement 208 (usually self-locking worm and wheel type) to a motor 210. Likewise, the drums 204A, 204B and 204C are connected through a common shaft 212 to a reduction gear arrangement 214 driven by a motor 216.

Wire lines 218 from each of the drums 202 and 204 are attached to pad eyes 82 disposed on the cover 64 of the container 52. The lines 218 are disposed over sheaves 222 supported over the respective pad eyes 82 by stantions 224. Turnbuckles 226 are provided in each line 218 above and below the pad eyes 82 for fine adjustment.

To lift the container 52, the motors 210 and 216 are energized to drive the drums 202 and 204 in complementary fashion to respectively draw-in and pay-out the associated wire lines to raise the container 52 in a coaxial fashion. When the motor 210 and 216 are deenergized, the container 52 is secured and locked in the desired elevational position with respect to the guides. When secured, the exterior of the lower surface of the container 52 is adapted to control the free-surface effect of the cargo disposed in the cargo containment volume 58 defined by the raising of the container 52. Any perceived irregularities during raising and lowering operations may be remedied by the turnbuckles 226. Note however, that slackening in the wire lines may occur, then necessitating a permanent locking arrangement, as the adjustable strut shown in FIG. 8. Locking strut 172 may be made adjustable in length by constructing one end of an inwardly threaded tube 172I and the other end of an outwardly threaded solid rod 172T, both ends to be protected against corrosive effects of sea water by the choice of basic material or by the choice of coating. The lower end may be made capable of transmitting either tension or compression by means of a hinge-pin connection 173. The upper end may be attached by means of a hollow nut 175, inwardly threaded, flanged and seated to receive a self-aligning washer 179; the nut screws onto an outwardly threaded stub 181 attached as by welding to the extending beam 176. The two ends are rotatable with respect to each other and are assured of rigid fixity between each other by means of a locknut arrangement 183.

If a hydraulic ram arrangement 164, as illustrated in FIGS. 2 and 3, is used as the lifting means 72 the stabilizing and clamping features discussed above may be accomplished by use of the synchronizing arrangement 74 as shown in FIGS. 16A–16C. FIGS. 16A and 16B are, respectively, plan and side elevations of a container 52 having equiangularly disposed thereabout hydraulic ram elements 164-1, 164-2 and 164-3. In FIG. 16A one ram 164-1 is attached to a girder 67 extending from the cover 64 of the container 52 while the rams 164-2 and 164-3 are connected to a header 228 by a suitable ball and socket connection 162'. Each cylinder end of ram 164 may be mounted to the deck (in an appropriate recess, if desired) by a universal joint as discussed in connection with FIGS. 2 and 3.

FIG. 16C is a schematic diagram of the hydraulic flow control arrangement for the array of rams 164 shown in FIGS. 16A and 16B.

With reference now to FIG. 16C, each array of rams 164 (the array comprising double-acting rams 164-1, 164-2, 164-3) for each container 52 is provided with a hydraulic synchronizing arrangement 74 to synchronize the operation of the lifting means 72 to control the lifting and lowering of the container 52 and to clamp the container 52 at the desired elevation. Thus, each container 52 having a lifting arrangement 72 comprising a hydraulic ram array 164 is provided with a hydraulic synchronizing arrangement 74. The synchronous lifting and lowering of each container 52 is controlled by the arrangement 74.

The synchronizing arrangement 74 is disposed within the hydraulic system for the rams 164. The hydraulic system includes a hydraulic fluid supply sump 240 connected to each ram array through each synchronizing arrangement 74 by a main inlet supply line 242 and a main return line 244. A filter 246 and a main pump 248 are connected in series in the inlet supply line 242 The pump 248 is driven by a prime mover 250.

The hydraulic fluid supply sump 240 is also connected to the synchronizing arrangement 74 associated with each array of rams 164 by a make-up supply line 252 and a make-up return line 254. The make-up supply line 252 has a pump 256 connected therein, the pump 256 being driven by the prime mover 250 in common with the main pump 248. The outlet of the pump 256 is connected to the sump 240 by a bypass loop 258 including a by-pass valve 260. The make-up supply line 252 and make-up return line 254 are connected to the other synchronizing arrangements 74 associated with other containers 52 by connections 262. The main hydraulic supply and the make-up supply are provided with relief valves 264 and 266, respectively. It is understood that if N containers are provided, each container 52 having an array of rams 164 as the lifting arrangement 72, then there are provided N synchronizing arrangements 74 connected between each array of rams 164 and the common sump 240.

Each of the synchronizing arrangements 74 includes a valve 270. The valve 270 is a four-way, open center valve with power-beyond feature. The valve 270 for the "first" sychronizing arrangement 74 is connected to the main supply line 242 and thence is connected through each of the N-1 other valves 270 and finally to the main return line 244. The supply line 242 is directly connected to the first of the valves 270 (disposed within the control arrangement 74 for a "first" of the N containers 52) while the main return line 244 is directly connected to the $N^{th}$ of the valves 270 (disposed within the control arrangement 74 for the $N^{th}$ container 52). The N control valves 270 are connected in series outlet to inlet and may be banked in one convenient physical location, if desired. Each valve 270 has two ram connecting ports 272A and 272B. Suitable valves 270 are those manufactured by Vickers, Inc., Detroit, Michigan, and sold under model number CM-2-NO2-R25-DDD-L-30.

The outlet port 272A is connected in parallel by lines 274 to the inlet of a flow equalizer 276. The flow equalizer 276 includes fluid pumps/motors 278. A fluid pump/motor 278 is provided for each ram 164 associated with a given container 52. As seen in FIG. 16, since each container 52 has three rams 164-1, 164-2 and 164-3 associated therewith, (as indicated diagrammatically in FIG. 16C), three fluid pumps/motors 278-1, 278-2 and 278-3 are provided within the flow equalizer 276. The shafts of the fluid pumps/motors 278 are interconnected by any suitable mechanical connection, as by a roller-chain shown at 280 or by a single continuous shaft. It is noted that any suitable fluid pump/motor, such as that sold by Delta Power Hydraulic Company, Rockford, Ill., under model number P27-60, may be used within the flow equalizer 276.

The outlet of the fluid pumps/motors 278 are connected to one side of the ram 164 with which it is associated by a line 282. The other side of the rams 164 are connected, in parallel, to a line 284 to the second port 272B of the valve 270. A cross-coupled pilot-operated check valve arrangement 286 (also referred to as a remote pressure control counter-balance valve) including check valves 286A and 286B, is disposed between the lines 282 and 284 connected to the rams 164. Each of the pairs of pilot-operated check valves 286A and 286B includes a biased check valve element appropriately connected to a pilot-operated piston. The other side of each piston is connected to the outlet of the other check valve element, as by lines 288 and 290. Suitable cross-coupled check valve arrangements are those sold by Vickers, Inc. under model number RCG-10-D-4.

For fine adjustments, each of the rams 164 is provided with two bleed valves 292A and 292B connecting each side of the ram piston to the make-up return line 254. Further, two make-up valves 294A and 294B are connected to each side of each ram piston, as shown in the Figures. The valves 294A and 294B are connected into the make-up supply line 252.

In operation, if it is desired to raise or lower a selected one of the N containers 52, the appropriate valve 270 is asserted. By the action of the equalizer 276, the rams 164 associated with that container 52 are supplied with a controlled fluid flow, to thereby synchronously raise or lower the container 52. Fine adjustments may be effected by the use of the make-up valves 294 and bleed valves 292. When raised, the rams 164 provide a clamping or locking feature to maintain the container at the desired position. However, since leakage of hydraulic fluid may occur, it is desirable to utilize a separate locking arrangement, as the safety strut 172 shown in FIG. 8, to lock the container 52 at its desired position.

Figure 18A:
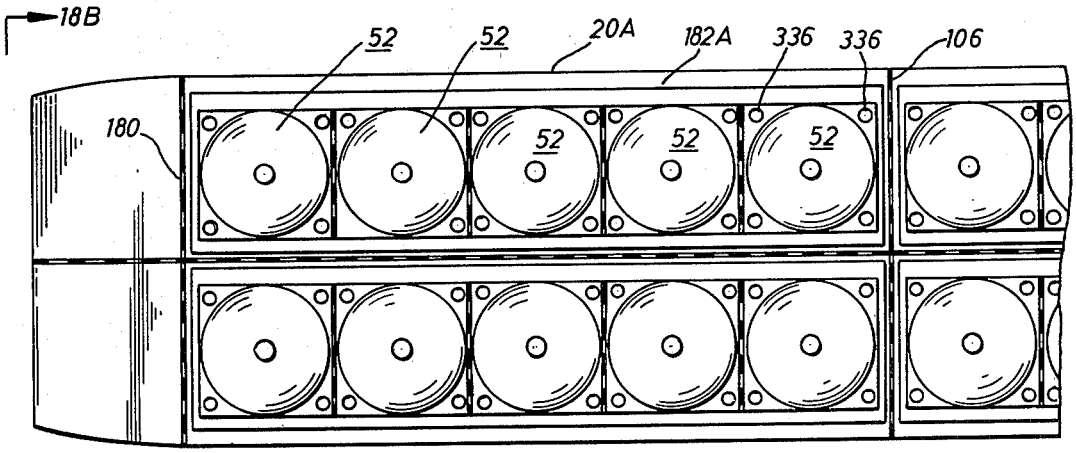
Figure 18B:
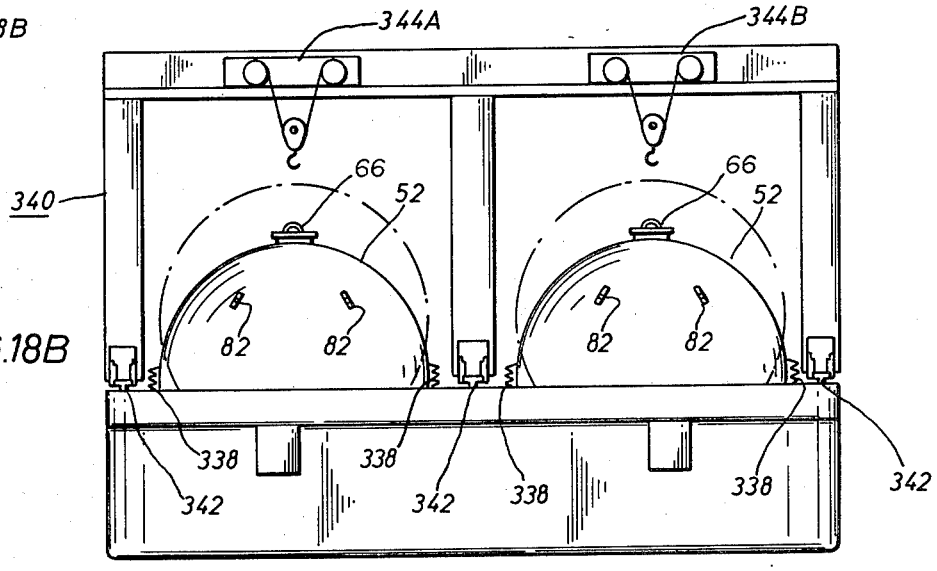
Figure 18C:
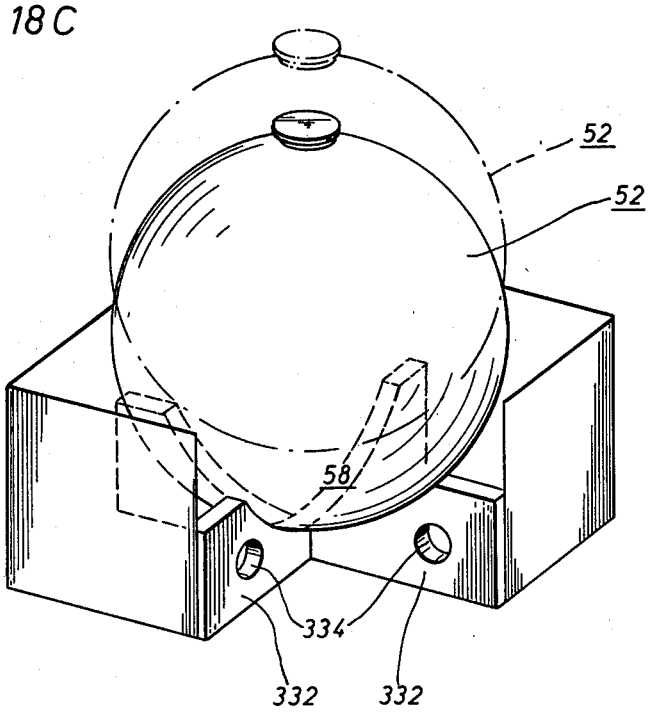
FIG. 18C is a perspective view of the container in the lowered and elevated position.
Figure 19:
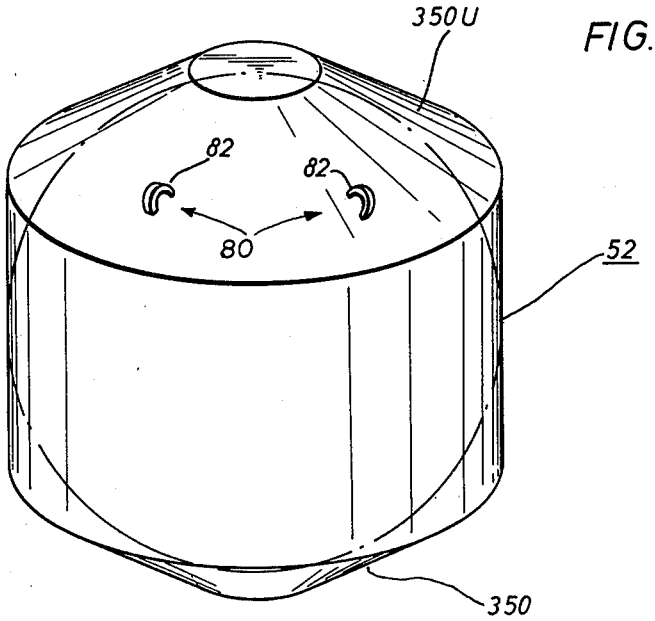

With reference to FIGS. 17 through 19, shown are alternate embodiments of a container in accordance with the invention. FIG. 17 shows an elongated, horizontally disposed container useful for the carriage of liquid cargoes at or moderately above or below atmospheric pressure as LPG. FIG. 18 illustrates spherical containers useful in the carriage of cargo at relatively high pressures above atmospheric, such as refrigerated liquified natural gas. FIG. 19 is a container having frustoconical ends disposed about a cylindrical central portion.

With reference to FIG. 17, a container 52 is shown as an elongated cylindrical member having a tubular body portion bounded at each end by dished heads 308A and 308B and by endplates 304A and 304B. Each endplate 304 is disposed a clearance distance 306 from a dished tank head 308. The cargo carrying volume 62 of the container 52 shown in FIG. 17 is defined by the interior of the body 302 and dished head sections 308. The space 310 defined between the exterior of the tank heads and the end plates 304 is a zone adapted to provide (along with longitudinal structural members 314 cooperating with plates 304) an adequate path for transfer of longitudinal forces between the container 52 (including its contents) and the structure of the barge 12. The space 310 may contain a force-transmitting material. Similar functions are provided by appurtenances referred to in the art as collision chocks. It is understood that the endplates 304 may be vertically curved sections such that their mating members (against which the end plates 304 slide when the container 52 is being raised and lowered) are shaped to provide a minimum of stress concentration in the deck 14.

Access to the volume 62 is gained through a hatch 66 provided with suitable covers. Pad eyes 82 are disposed at predetermined spaced locations along the body 302 of the container 52. The pad eyes 82 are adapted to receive or engage lifting means which may be disposed on the structure of barge or at a location other than on the barge.

Each of the containers 52, as shown in FIG. 17A, are positioned parallel to the longitudinal axis along the length of the barge 12. Although FIG. 17A illustrates two pairs of containers 52 arrayed end-to-end along the length of the barge, any number of containers 52 may be used, consistent with the dimensioning of the barge 12.

Figure 17B:
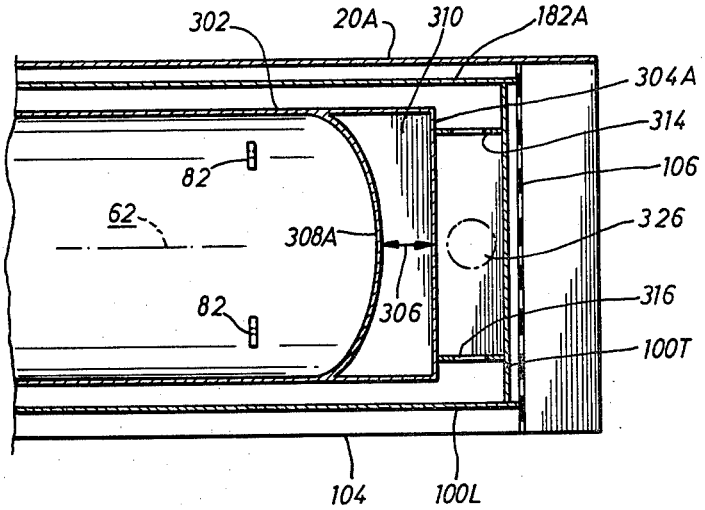
FIG. 17B is an enlarged plan view, partially in section, of one of the containers shown in FIG. 17A.

Each of the containers 52 is disposed within a receptacle defined within the barge 12 by the barge inner bottom 60, the barge inner sideshells 182, fore and aft watertight transverse bulkheads 180, transverse watertight bulkheads 106 and longitudinally bulkheads 100L disposed parallel to the sideshells 20 and the longitudinal centerline bulkhead 104. Of course, as shown in FIG. 17B, the receptacle may also be defined by transverse bulkheads 100T, if desired. Any suitable support elements as webs, stiffeners, and trusses (not illustrated in FIGS. 17–18) similar to those shown in FIGS. 4 and 5, support the structural members last-recited in a manner appreciated by those skilled in the art. Suitable guide members 314, having openings 316 therein, are provided at each axial end of the container 52.

The containers are received within the receptacles defined on the interior of the barge by a first set of transverse cradles 322 provided with openings 324 therein. The cradles are secured between the inner sideshells or guides 182 and the longitudinal bulkheads 100L by suitable means of attachment, as welding. Another set of cradles 322, having openings 324 therein, are mounted to the container 52 at locations so as to minimize the bending stresses imposable on the container 52, i.e., approximately one-fifth the axial length of the container 52 from each dished head 308 thereof.

With the containers 52 in the second, elevated, position, shown in FIG. 17D, the cargo receiving volume 58 is defined between the exterior of the container 52 (including both the body 302 and the end plates 304) and the interior of the receptacle. Access means 90 for loading and unloading cargo into and out of the cargo receiving volume 58 is defined by hatches 326A and 326B, each having covers 328 thereon. The hatches are conveniently located adjacent each end plate 304. A suitable accordion seal element 330 is provided between the deck 14 and the container 52 to protect the receptacle and cargo receiving volume 58 definable therein from the entry thereinto of foreign matter.

It may be appreciated in view of the foregoing that with the container 52 in the elevated position (FIG. 17D) the cargo receiving volume 58 defined by the residual volume in combination with the enlargement volume generated when the container 52 is elevated is a commercially attractive carriage volume, whereas the residual volume alone is not. Accordingly, cargoes may be carried in the cargo carrying volume 62 disposed on the interior of the container 52 and in the cargo receiving volume 58 defined when the container 52 is in the elevated position. Of course, both, neither or either of the container 52 and/or the receptacle may be insulated, as discussed above, and may be provided with suitable lifting means 72, synchronizing means 74, or locking means 76, as discussed in connection with FIGS. 1 through 18.

Referring now to FIGS. 18A and 18B, an alternate embodiment of the container 52 in accordance with the invention is shown. In this embodiment, the container 52 is a substantially spherical member adapted to carry a cargo as liquid natural gas. Each container 52 has a cargo carrying volume 62 on the interior thereof, access to which is provided through covered hatches 66. Each container 52 is provided with an array of pad eyes 82 for purposes similar to those discussed above.

The containers 52 are each received within receptacles defined within the barge 12 by the longitudinal bulkheads 100L, inner sideshells 182, and inner bottom 66, in a manner similar to that discussed in connection with FIGS. 17C and 17D. However, an increased number of receptacles is defined (dependent, of course, upon the size of the containers 52) by interior transverse bulkheads 100T and end transverse bulkheads 180 and by the bulkhead 106. Each receptacle has disposed therein intersecting cradles 332A and 332B, each being provided with openings 334 (FIG. 18C). With the container 52 in the elevated position (shown in dot-dash lines in FIG. 18C) the cargo receiving volume 58 is defined within the receptacle by the combination of the residual and enlargement volumes. Cargo may be introduced and withdrawn from the cargo receiving volumes through access hatches 336, each provided with suitable covers. Again, seals 338 are provided (FIG. 18B).

As seen in FIG. 18B, a longitudinally movable crane 340 is movable along the length of the barge 12 on suitable rails 342. The crane is provided with a transversely movable wire line hoist arrangement 344A and 344B to assist in raising the containers 52 to the elevated position. Again, as in connection with FIG. 17 and 19, the container 52 or the receptacle may be insulated, if desired, and may be provided with any suitable lifting means, synchronizing means, or locking arrangement, in accordance with the teachings of this invention.

In FIG. 19, another embodiment of a container 52 in accordance with the invention is shown. In FIG. 19, the container 52 includes a central cylindrical portion closed at each and by an upper and lower frustoconical portions 350U and 350L. This embodiment of the container 52 is believed advantageous for its relative ease of manufacture, as compared to the embodiment of the container shown in FIG. 18. The container 52 shown in FIG. 19 is received in suitable receptacles, similar to those shown in FIGS. 18A and 18C, as may be appreciated by those skilled in the art once having benefit of the teachings herein.

The container 52 of FIG. 19 has the property of withstanding design internal and external pressures through the interaction of stresses within the shell only without special stiffening or bracing; however, the sphere is a surface of socalled double curvature and without straight-line elements, while the frustoconical embodiment consists basically of surfaces of single curvature and straight line elements, hence it can be manufactured in a simple roll or press brake, whereas the spherical construction requires more expensive die and press work. The cylindrical portion and the frustro-conical portions of the container are generated by straight line elements rotated about the axis of symmetry. It is understood that the ends may be efficiently closed by small dished heads of relatively easy manufacture.

In view of the foregoing, it may be appreciated that with a cargo transport system of the invention, dissimilar and incompatible cargos (as hot asphalt and grain, for example) may be carried by the same barge on different legs of a transport journey. For example, when it may be desired to carry heated, viscous material, as asphalt, from one port to delivery to another, it may be commercially advantageous to provide a separate cargo receiving volume adapted to carry a dissimilar cargo, as grain, on the return leg of the journey.

In accordance with this invention, the heated viscous material may be carried on the first leg within the cargo carrying volume 62 on the interior of the container 52. Due to the insulation and/or heating coils, the material at the time of unloading is at an elevated temperature and more easily removable from the container at the intended destination. In order to define the second, separate receiving volume of a commercially advantageous size, the container 52 is lifted to the elevated position, and the second cargo introduced into the receiving volume 58 defined on the interior of the receptacle. In this way, a dissimilar cargo, as cement, grain, or slurry coal, is effectively and conveniently transportable on the return leg, without possibility of contamination due to carriage in the same volume used to transport the heated, viscous, asphalt.

Of course, the cargo transport system of this invention may be used for the carriage of any desired combination of dissimilar cargoes in the volumes 58 and 62. Furthermore, the dissimilar cargoes may be carried at the same time by the same cargo transport system 10. when this is done, of course, the additional loads imposed on the lifting means are to be recognized and proportioned accordingly.

Having defined a preferred embodiment of the invention those skilled in the art may effect numerous modifications thereto in view of the description given hereinabove. It is therefore understood that such modifications lie within the scope of this invention as defined in the appended claims.

What is claimed is:

1. Apparatus for transporting cargo comprising:

a receptacle adapted to receive a container;

a container having a cargo carrying volume therein, the container being movable with respect to the receptacle from a first to a second position; in the second position the exterior of the container and the interior of the receptacle cooperating to define a cargo receiving volume separate from the cargo carrying volume within the container; and, a cargo access arrangement for introducing bulk cargo into the cargo receiving volume without removal of the container from the receptacle.

2. Apparatus according to claim 1 further comprising:

lifting means for moving the container from the first to the second position.

3. Apparatus according to claim 2 further comprising:

means for synchronizing the lifting means to move the container from the first to the second position in a fashion such that the container is in a substantially parallel relationship with a datum throughout the movement of the container from the first to the second position.

4. Apparatus according to claim 3 further comprising:

an indexing guide arrangement to maintain alignment of the container and the lifting means and to prevent rotation of the container with respect to the receptacle throughout the movement of the container from the first to the second position.

5. Apparatus according to claim 4 further comprising:

a locking arrangement for securing the container in the second position such that the exterior surface of the container which cooperates with the receptacle to define the cargo receiving volume is disposed in a fashion to limit free surface effects when a cargo is introduced into the cargo receiving volume.

6. Apparatus according to claim 1 further comprising:

lifting means for moving the container from the first to the second position in a fashion such that the exterior surface of the container which cooperates to define the cargo receiving volume is in a substantially parallel relationship with a portion of the receptacle throughout the movement of the container from the first to the second position.

7. Apparatus according to claim 6 further comprising:

an indexing guide arrangement to maintain alignment of the container and the lifting means throughout the movement of the container from the first to the second position.

8. Apparatus according to claim 7 further comprising:

a locking arrangement for securing the container in the second position such that the exterior surface of the container which cooperates with the receptacle to define the cargo receiving volume is disposed in a fashion to limit free surface effects when a cargo is introduced into the cargo receiving volume.

9. Apparatus according to claim 2 further comprising:

an indexing guide arrangement to maintain alignment of the container and the lifting means throughout the movement of the container from the first to the second position.

10. Apparatus according to claim 9 further comprising:

a locking arrangement for securing the container in the second position such that the exterior surface of the container which cooperates with the receptacle to define the cargo receiving volume is disposed in a fashion to limit free surface effects when a cargo is introduced into the cargo receiving volume.

11. Apparatus according to claim 1 further comprising:

a locking arrangement for securing the container in the second position such that the exterior surface of the container which cooperates with the receptacle to define the cargo receiving volume is disposed in a fashion to limit free surface effects when a cargo is introduced into the cargo receiving volume.

12. Apparatus according to claim 1 further comprising:

means associated with the container adapted to receive and to connect the container to an arrangement for moving the container from the first to the second position.

13. Apparatus according to claim 1, wherein a predetermined residual volume is defined between the container and the receptacle when the container is in the first position, the cargo receiving volume defined within the receptacle when the container is in the second position comprising the residual volume and an enlargement volume vacated by the container when the container is moved from the first to the second position.

14. Apparatus according to claim 1 further comprising:

a guide arrangement disposed within the receptacle for guiding the movement of the container from the first to the second position.

15. Apparatus according to claim 14 wherein the guide arrangement comprises an array of guide rails.

16. Apparatus according to claim 1 wherein the container is provided with a cover and wherein the cover is provided with openings through which cargo may be introduced and removed from the cargo carrying volume on the interior of the container.

17. Apparatus according to claim 16 further comprising:

insulating material disposed on the container and the cover to facilitate the carriage of an elevated temperature cargo within the cargo carrying volume with a minimum of heat loss.

18. Apparatus according to claim 17 further comprising:

insulating material disposed on the receptacle to facilitate the carriage of an elevated temperature cargo within the cargo carrying volume with a minimum of heat loss.

19. Apparatus according to claim 1 further comprising:

insulating material disposed on the container to facilitate the carriage of an elevated temperature cargo within the cargo carrying volume with a minimum of heat loss.

20. Apparatus according to claim 1 further comprising:

insulating material disposed on the receptacle to facilitate the carriage of an elevated temperature cargo within the cargo carrying volume with a minimum of heat loss.

21. Apparatus according to claim 1 further comprising:

insulating material disposed on the container and on the receptacle to facilitate the carriage of an elevated temperature cargo within the cargo carrying volume with a minimum of heat loss.

22. Apparatus according to claim 1 further comprising:

a heating arrangement disposed on the container to raise the temperature of a cargo carried within the cargo carrying volume.

23. Apparatus according to claim 1 wherein the receptacle comprises a continuous sleeve having a bottom closure, the sleeve being sized to receive the container in a close-fitting relationship, the cargo receiving volume being defined between the exterior of the container and the interior of the sleeve and bottom closure when the container is in the second position.

24. A cargo transport barge comprising:

a deck having an opening therein;

a container having a cargo carrying volume therein disposed within the opening in the deck;

a receptacle defined within the barge below the deck, the receptacle being sized to receive the container;

means for lifting the container from a first position to a second position, in the second position the exterior of the container and the interior of the receptacle cooperating to define a cargo receiving volume separate from the cargo carrying volume;

a cargo access arrangement for introducing bulk cargo into the cargo receiving volume without removal of the container from the receptacle.

25. Apparatus according to claim 24 further comprising:

means for synchronizing the lifting means to move the container from the first to the second position in a fashion such that the container is in a substantially parallel relationship with a datum throughout the movement of the container from the first to the second position.

26. Apparatus according to claim 25 further comprising:

a locking arrangement for securing the container in the second position such that the exterior surface of the container which cooperates with the receptacle to define the cargo receiving volume is disposed in a fashion to limit free surface effects when a cargo is introduced into the cargo receiving volume.

27. Apparatus according to claim 24 further comprising:

a locking arrangement for securing the container in the second position such that the exterior surface of the container which cooperates with the receptacle to define the cargo receiving volume is disposed in a fashion to limit free surface effects when a cargo is introduced into the cargo receiving volume.

28. Apparatus according to claim 27 further comprising:

an indexing guide arrangement to maintain alignment of the container and the lifting means throughout the movement of the container from the first to the second position.

29. Apparatus according to claim 24, wherein a predetermined residual volume is defined between the container and the receptacle when the container is in the first position, the cargo receiving volume defined within the receptacle when the container is in the second position comprising the residual volume and an enlargement volume vacated by the container when the container is moved from the first to the second position.

30. Apparatus according to claim 24 wherein the receptacle comprises a continuous sleeve having a bottom closure the sleeve being sized to receive the container in a close-fitting relationship, the cargo receiving volume being defined between the exterior of the container and the interior of the sleeve and bottom closure when the container is in the second position.

31. Apparatus according to claim 24 wherein the container is provided with a cover and wherein the cover is provided with openings through which cargo may be introduced and removed from the cargo carrying volume on the interior of the container.

32. Apparatus according to claim 24 further comprising:

insulating material disposed on the container to facilitate the carriage of an elevated temperature cargo within the cargo carrying volume with a minimum of heat loss.

33. Apparatus according to claim 24 further comprising:

insulating material disposed on the receptacle to facilitate the carriage of an elevated temperature cargo within the cargo carrying volume with a minimum of heat loss.

34. Apparatus according to claim 24 further comprising:

insulating material disposed on the container and on the receptacle to facilitate the carriage of an elevated temperature cargo within the cargo carrying volume with a minimum of heat loss.

35. A cargo transport barge comprising:

a deck having an opening therein;

a container having a cargo carrying volume therein disposed within the opening in the deck;

a receptacle defined within the barge below the deck, the receptacle being sized to receive the container;

means associated with the container adapted to receive and to connect the container to an arrangement for moving the container from the first to the second position; and a cargo access arrangement for introducing bulk cargo into the cargo receiving volume without removal of the container from the receptacle.

36. Apparatus according to claim 35 further comprising:

a locking arrangement for securing the container in the second position such that the exterior surface of the container which cooperates with the receptacle to define the cargo receiving volume is disposed in a fashion to limit free surface effects when a cargo is introduced into the cargo receiving volume.

37. Apparatus according to claim 35, further comprising:

an indexing guide arrangement to maintain alignment of the container and the arrangement for moving the container throughout the movement of the container from the first to the second position.

38. Apparatus according to claim 35, wherein a predetermined residual volume is defined between the container and the receptacle when the container is in the first position, the cargo receiving volume defined within the receptacle when the container is in the second position comprising the residual volume and an enlargement volume vacated by the container when the container is moved from the first to the second position.

39. Apparatus according to claim 35 wherein the receptacle comprises a continuous sleeve having a bottom closure, the sleeve being sized to receive the container in a close-fitting relationship, the cargo receiving volume being defined between the exterior of the container and the interior of the sleeve and bottom closure when the container is in the second position.

40. Apparatus according to claim 35 wherein the container is provided with a cover and wherein the cover is provided with openings through which cargo may be introduced and removed from the cargo carrying volume on the interior of the container.

41. Apparatus according to claim 35 further comprising:

insulating material disposed on the container to facilitate the carriage of an elevated temperature cargo within the cargo carrying volume with a minimum of heat loss.

42. Apparatus according to claim 35 further comprising:

insulating material disposed on the receptacle to facilitate the carriage of an elevated temperature cargo within the cargo carrying volume with a minimum of heat loss.

43. Apparatus according to claim 35 further comprising:

insulating material disposed on the container and on the receptacle to facilitate the carriage of an elevated temperature cargo within the cargo carrying volume with a minimum of heat loss.

44. A method of transporting a first and a second cargo from a first location to a second location comprising the steps of:

lifting a container having a cargo carrying volume therein from a first to a second position with respect to a carrier to define in cooperation with the carrier a receptacle having a separate cargo receiving volume therein; and introducing a first cargo into the cargo receiving volume without removal of the container from the receptacle.

45. The method of claim 44 further comprising the step of:

locking the container in the second position such that the exterior surface of the container which cooperates with the carrier to define the receptacle limits the free surface effect of the first cargo.

46. The method of claim 44 wherein the lifting step is performed in a fashion such that the exterior surface of the container is maintained in a substantially parallel relationship with a portion of the carrier defining the receptacle.

47. The method of claim 44 further comprising the step of:

introducing a second cargo into the cargo carrying volume.

48. The method of claim 47 further comprising the steps of:

insulating the container to maintain the cargo in the cargo carrying volume at an elevated temperature.

49. Apparatus for transporting cargo comprising:

a receptacle adapted to receive a container;

a container having a cargo carrying volume therein, the container being movable with respect to the receptacle from a first to a second position; in the second position the exterior of the container and the interior of the receptacle cooperating to define a cargo receiving volume separate from the cargo carrying volume within the container;

a cargo access arrangement for introducing a cargo into the cargo receiving volume; and a guide arrangement disposed within the receptacle for guiding the movement of the container from the first to the second position, wherein the guide arrangement comprises a perforated sleeve disposed within the receptacle to both guide the movement of the container and to limit cargo shifting when a cargo is introduced within the cargo receiving volume.

50. Apparatus for transporting cargo comprising:

a receptacle adapted to receive a container;

a container having a cargo carrying volume therein, the container being movable with respect to the receptacle from a first to a second position; in the second position the exterior of the container and the interior of the receptacle cooperating to define a cargo receiving volume separate from the cargo carrying volume within the container;

a cargo access arrangement for introducing a cargo into the cargo receiving volume, the cargo access arrangement comprising an enclosed shaft extending through and isolated from the cargo carrying volume, wherein the receptacle comprises a continuous sleeve having a bottom closure, the sleeve being sized to receive the container in a close-fitting relationship, the cargo receiving volume being defined between the exterior of the container and the interior of the sleeve and bottom closure when the container is in the second position.

51. Apparatus according to claim 50 wherein the container and the shaft are both right circular cylinders and wherein the volume occupied by the shaft is related to the cargo carrying volume defined within the container such that an increase in the height of the sidewall of the container equal to the dimension defined by the square of the ratio of the diameters of the shaft and the container multipled by the height of the container restores to the container the volume occupied by the shaft.

52. Apparatus for transporting cargo comprising:

a receptacle adapted to receive a container;

a container having a cargo carrying volume therein, the container being movable with respect to the receptacle from a first to a second position; in the second position the exterior of the container and the interior of the receptacle cooperating to define a cargo receiving volume separate from the cargo carrying volume within the container; wherein the container is a cylindrical member, the elongate axis of which is disposed in a plane extending substantially parallel to a plane containing the portion of the receptacle defining the lowermost bounding surface of the cargo receiving volume; and a cargo access arrangement for introducing a cargo into the cargo receiving volume.

53. Apparatus for transporting cargo comprising:

a receptacle adapted to receive a container;

a container having a cargo carrying volume therein, the container being movable with respect to the receptacle from a first to a second position; in the second position the exterior of the container and the interior of the receptacle cooperating to define a cargo receiving volume separate from the cargo carrying volume within the container; wherein the container is a substantially spherical member; and a cargo access arrangement for introducing a cargo into the cargo receiving volume.

54. Apparatus for transporting cargo comprising:

a receptacle adapted to receive a container;

a container having a cargo carrying volume therein, the container being movable with respect to the receptacle from a first to a second position; in the second position the exterior of the container and the interior of the receptacle cooperating to define a cargo receiving volume separate from the cargo carrying volume within the container; wherein the container comprises a member having a cylindrical central portion connected at each open end to a frustoconical portion; and a cargo access arrangement for introducing a cargo into the cargo receiving volume.

* * * * *